US008001904B2

(12) United States Patent
Maes et al.

(10) Patent No.: US 8,001,904 B2
(45) Date of Patent: Aug. 23, 2011

(54) FALL ARREST ASSEMBLY

(75) Inventors: Koen Maes, Hoboken (BE); Bart Maes, Hoboken (BE)

(73) Assignee: Exponent Challenge Technology, Hoboken (BE)

( * ) Notice: Subject to any disclaimer, the term of this patent is extended or adjusted under 35 U.S.C. 154(b) by 0 days.

(21) Appl. No.: 12/452,005

(22) PCT Filed: Jun. 13, 2007

(86) PCT No.: PCT/BE2007/000060

§ 371 (c)(1),
(2), (4) Date: Dec. 11, 2009

(87) PCT Pub. No.: WO2008/151397

PCT Pub. Date: Dec. 18, 2008

(65) Prior Publication Data

US 2010/0108440 A1 May 6, 2010

(51) Int. Cl.
*B61B 7/00* (2006.01)

(52) U.S. Cl. ..... 104/112; 104/113; 104/115; 104/117; 182/3; 182/36

(58) Field of Classification Search ..... 104/112, 104/113, 115, 117; 182/3, 36
See application file for complete search history.

(56) References Cited

U.S. PATENT DOCUMENTS

| | | | | |
|---|---|---|---|---|
| 4,790,410 | A * | 12/1988 | Sharp et al. | 182/36 |
| 5,224,427 | A * | 7/1993 | Riches et al. | 104/115 |
| 5,297,651 | A * | 3/1994 | Vandelinde | 182/3 |
| 5,979,599 | A * | 11/1999 | Noles | 182/36 |
| 6,056,085 | A * | 5/2000 | Cutter et al. | 182/36 |
| 6,260,661 | B1 * | 7/2001 | Cutter et al. | 182/45 |
| 6,298,629 | B1 * | 10/2001 | Ador | 52/698 |
| 6,330,861 | B1 * | 12/2001 | Flux | 104/115 |
| 6,488,118 | B1 * | 12/2002 | Corriveau | 182/36 |
| 6,604,605 | B2 * | 8/2003 | Peterson et al. | 182/36 |
| 6,640,727 | B2 * | 11/2003 | Ostrobrod | 104/91 |
| 6,736,239 | B2 * | 5/2004 | Peterson et al. | 182/36 |
| 6,802,390 | B2 * | 10/2004 | Peterson et al. | 182/36 |
| 2003/0029672 | A1 * | 2/2003 | Argoud | 182/36 |
| 2003/0192739 | A1 * | 10/2003 | Peterson et al. | 182/36 |
| 2003/0192740 | A1 * | 10/2003 | Peterson et al. | 182/36 |
| 2004/0211622 | A1 * | 10/2004 | Renton et al. | 182/3 |
| 2006/0090960 | A1 * | 5/2006 | Liggett | 182/36 |
| 2007/0017740 | A1 * | 1/2007 | Geens et al. | 182/3 |
| 2007/0119653 | A1 * | 5/2007 | Brown et al. | 182/36 |
| 2010/0108440 | A1 * | 5/2010 | Maes et al. | 182/3 |
| 2010/0230207 | A1 * | 9/2010 | Larson et al. | 182/5 |

FOREIGN PATENT DOCUMENTS

| | | |
|---|---|---|
| EP | 1222944 | 7/2002 |
| EP | 1733763 | 12/2006 |
| WO | 03/045504 | 6/2003 |

* cited by examiner

*Primary Examiner* — S. Joseph Morano
*Assistant Examiner* — Jason C Smith
(74) *Attorney, Agent, or Firm* — Dowell & Dowell, PC

(57) ABSTRACT

A fall arrest assembly having belay lines and anchor stations extending between support structures and which slidably receive a shuttle mounted to a person traversing the belay lines, the assembly including a mounting plate having a plurality of openings therethrough and a supporting extension fixed rigidly thereto and wherein the support extension carries a shuttle guide coupled to the belay lines and configured for slidable passage of a shuttle there over, and a plurality of anchor elements having a section configured to extend through the plurality of openings in the mounting plate and clamps for securing the anchor elements to the support structures.

20 Claims, 23 Drawing Sheets

F35

FALL ARREST ASSEMBLY

BACKGROUND OF THE INVENTION

1. Field of the Invention

The present invention relates to a fall arrest assembly.

2. Brief Description of the Related Art

In a typical fall arrest assembly or personal belay system, the user is fitted with a harness that may be removably clipped to a shuttle or glider. The shuttle is configured to slide easily along an array of belay lines in the form of suspended ropes or cables. Common forms of personal fall arrest assemblies are used in the construction and building maintenance industries where workers are performing tasks at dangerous heights, such as high-rise building construction, window washing and roof repairs. In these common systems, the runs are relatively short and often include a cable run dedicated to each worker. Moreover, the cable runs are usually fixed, stable and geometrically simple and predictable. For instance, in building constructions, the runs follow existing horizontal beams of the building and are anchored to the building vertical beams.

Fall arrest assemblies are also finding increasing use in the recreation and adventure market. Fall arrest assemblies are essential gear for mountain climbing, rock climbing and rappelling. More recently, fall arrest systems have been used in obstacle and adventure courses in which a participant must negotiate a hazardous and unstable course. Such a course may include an elevated "trail" formed by mostly horizontal ropes, suspended logs, rocks and the like. In these adventure courses, the fall arrest assembly must provide security against an accidental fall, without inhibiting the participant's freedom of movement.

Unlike the commercial and industrial uses described above, the fall arrest assembly in the adventure course typically involves long belay line runs and is aimed at an extremely active participant. In some adventure courses, the participants take part in a race and will be moving as fast as possible. The belay system must therefore not interfere with the rapid traverse of the adventurer and must be flexible enough to be set up wherever the adventure course may go. In some adventure courses, multiple participants may be traversing the same run at the same time, so the belay system must be able to accommodate multiple safety cables/ropes and multiple shuttles/gliders.

As participants demand more and more excitement, the adventure course will increase in complexity and risk. Consequently, there is a need for a modular fall arrest assembly that can grow with the adventure course while providing the greatest degree of flexibility and usability possible.

Such a fall arrest assembly or personal belay system is disclosed by EP 1.733.763, wherein a modular system is described with components that can be used on a wide range of objects to form a wide range of belay line runs. The modular system is thereby composed of a mounting plate that is mounted to a support, such as a tree or a post, whereby the mounting plate is provided with several holes for receiving anchor elements therethrough. The mounting plate is also provided with an arrangement of slots configured to receive a band or strap that encircles the object.

The mounting plate also includes several slots for receiving adjustable spacers. The spacers are configured to contact the object support when the mounting plate is mounted to the support by the anchor elements. The spacers can be adjusted to account for variations in the surface of the object to ensure that the mounting plate maintains a stable and accurate orientation.

Each mounting plate supports one or more support plates that each contain a shuttle guide. The shuttle guide is adapted for slidable passage of a shuttle that is part of the user's personal fall arrest system. The shuttle guide also forms part of the belay line run, and in particular is configured to engage segments of the line that are combined to form the entire run. The shuttle guides include a tubular body with internal threads at its opposite ends. A profile tip is provided for each end in which the profile tip includes a threaded stem for engagement with the internal threaded ends of the tubular body. The profile tip is hollow so that a portion of a segment of the belay line may extend through the tip with the end of the segment disposed within the body.

A ferrule or similar element is affixed to the end of the segment thereby trapping the belay line segment on the end of the profile tip. When the profile tip is threaded into the tubular body, the segment is fastened to the body, and ultimately to the support extension of the anchor system. A complete belay line run is then formed by coupling segments of the run to the ends of a shuttle guide.

A major disadvantage of such a fall arrest assembly is that the supports described therein are rather prone to metal fatigue because they are manufactured by a method that includes a folding step.

SUMMARY OF THE INVENTION

To this end, the invention concerns a fall arrest assembly having belay lines and anchor stations extending between objects which is adapted to slidably receiving a shuttle coupled to a person traversing the belay lines, the assembly comprising a mounting plate defining a plurality of openings therethrough, characterized in that the assembly further comprises:

- a support extension fixed rigidly to said mounting plate;
- said support extension carrying a shuttle guide thereon;
- said shuttle guide configured for slidable passage of a shuttle thereover and further configured to be coupled to the belay lines;
- a plurality of anchor elements having a section configured to extend through said plurality of openings in said mounting plate;
- means of clamping the anchor elements around an object.

The advantage of a fall arrest assembly according to the invention is that it provides a stronger means of clamping a fall arrest system around poles or trees or other objects because the support extension is fixed rigidly to the mounting plate.

Furthermore, the support extension can be manufactured by a cheaper production process in that cut-off profiles can be used directly, which makes these profiles of the support extensions less prone to metal fatigue.

In a preferred embodiment, two shuttle guides are carried on the support extension in such a way that the same support extension can be used when the belay run crosses between two objects. Hereby the lower part of the support extension is a profile, preferably symmetrical in the line of the belay run in such a way that the "outside" shuttle guide is carried on the outer side of the support extension and the "inside" shuttle guide is located between the support extension and the object to which the support extension is mounted. In the known prior art two different support profiles had to be used, the first to be applied outside of the first object, the second to be applied inside the second object. The symmetrical profile proposed according to the invention can be used both inside and outside an object, which offers greater flexibility with less required parts for the fall arrest assembly.

BRIEF DESCRIPTION OF THE DRAWINGS

With the intention of better showing the characteristics of the invention, hereafter, as an example without any limitative character, a preferred form of embodiment is described of an improved fall-arrest system according to the invention, with, reference to the accompanying drawings, wherein.

DESCRIPTION OF THE PREFERRED EMBODIMENTS

Figure 1:
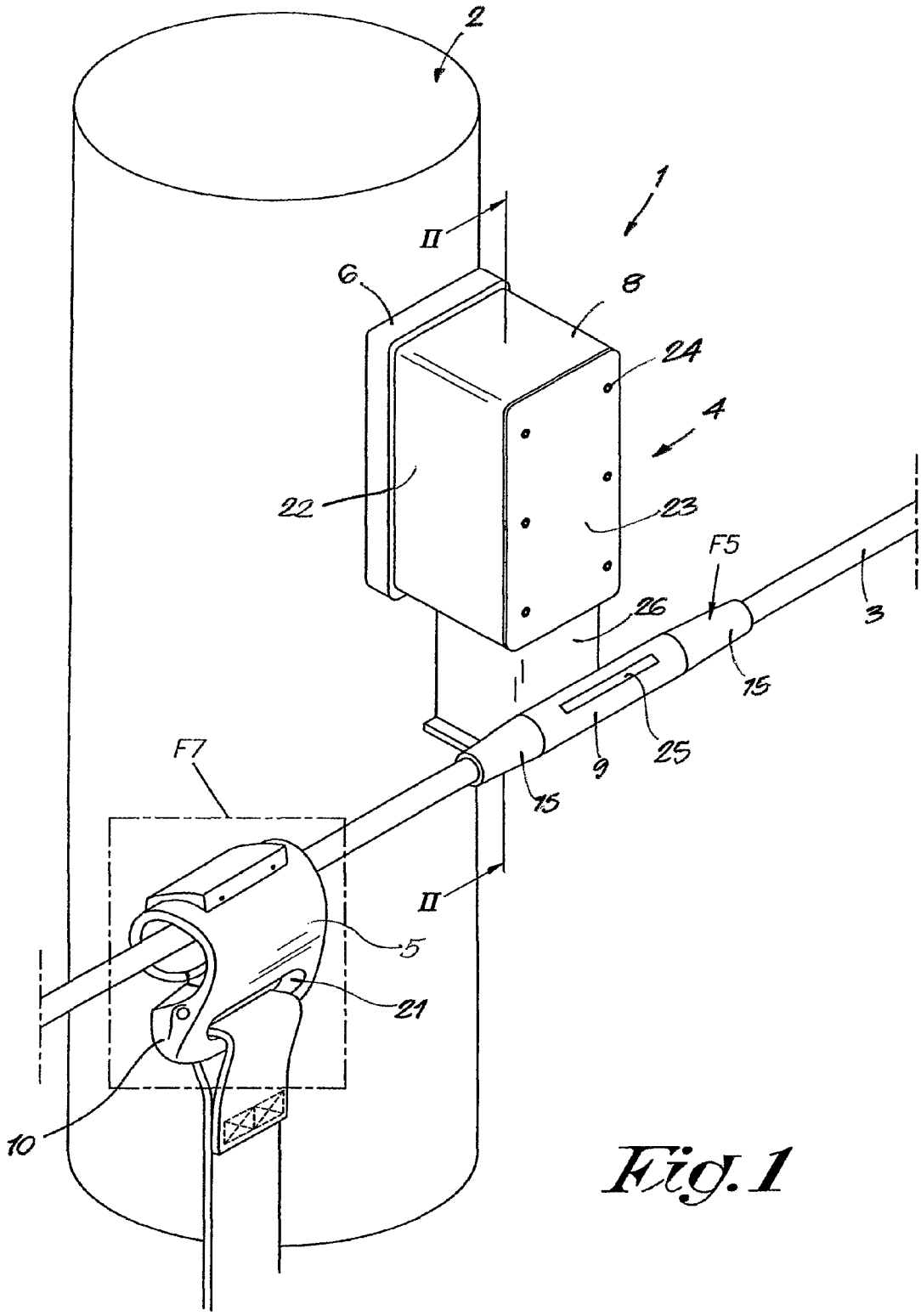
FIG. 1 shows a fall arrest assembly in perspective.

FIG. 1 shows the schematics to attach a fall arrest assembly 1 around one of a plurality of objects 2 whereby the fall arrest assembly 1 has a belay line 3 extending between anchor stations 4 that are adapted to slidably receive a shuttle 5 coupled to a person traversing the belay lines 3.

Figure 2:
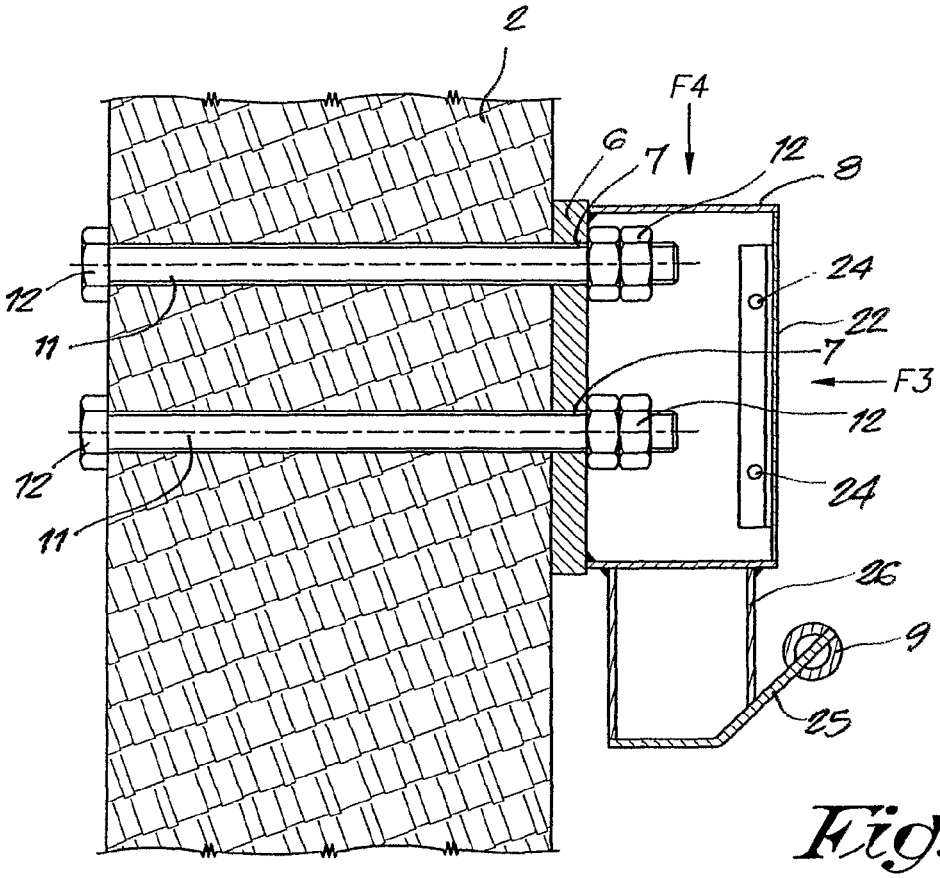
FIG. 2 depicts a side view of FIG. 1 according to II-II.

FIG. 2 shows that the anchor station 4 comprises a mounting plate 6 defining a plurality of openings 7 therethrough.

The anchor station 4 of the assembly 1 further comprises a support extension 8 which is fixed rigidly to the mounting plate 6 and carries a shuttle guide 9 thereon. The shuttle guide 9 is configured for slidable passage of a shuttle 10 thereover and is further configured to be coupled to the belay lines 3.

Figure 3:
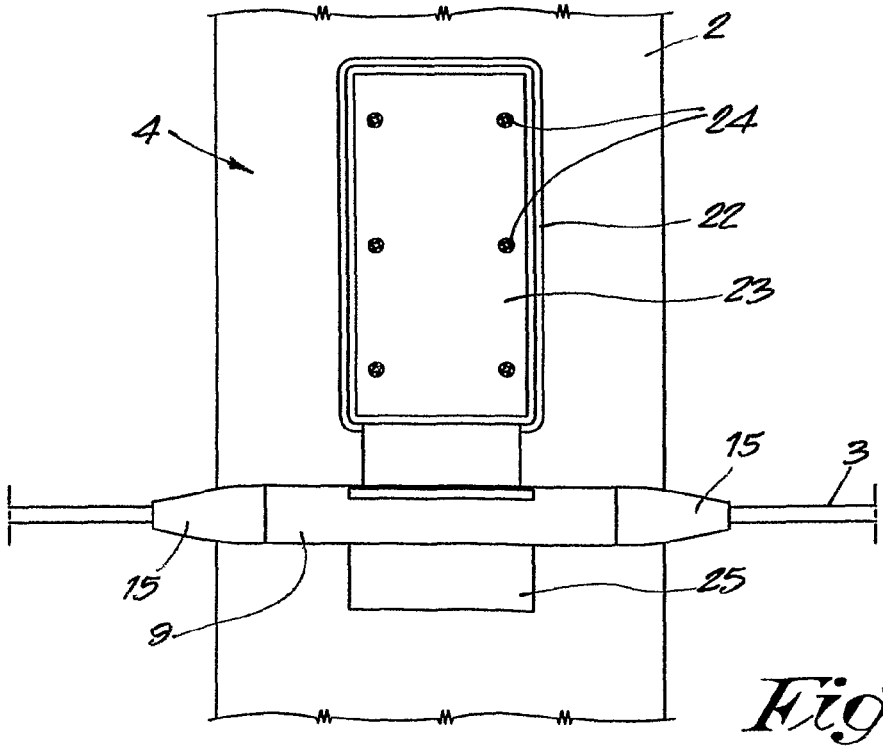
FIG. 3 shows a front view of FIG. 2 according to F3.

As shown in FIGS. 2 and 3, each anchor station 4 of the fall arrest assembly 1 further comprises a plurality of anchor elements 11 having a section configured to extend through the plurality of openings 7 in the mounting plate 6.

FIG. 2 also shows that the anchor elements 11 protrude through the object 2 and are clamped to it on either side by means of a series of nuts 12.

In a preferred embodiment the anchor elements 11 are provided in the form of threaded rods which allow adjustment of the clamping force and a sufficient number of openings 7 are provided on each mounting plate 6 to allow for safe anchoring.

Figure 4:
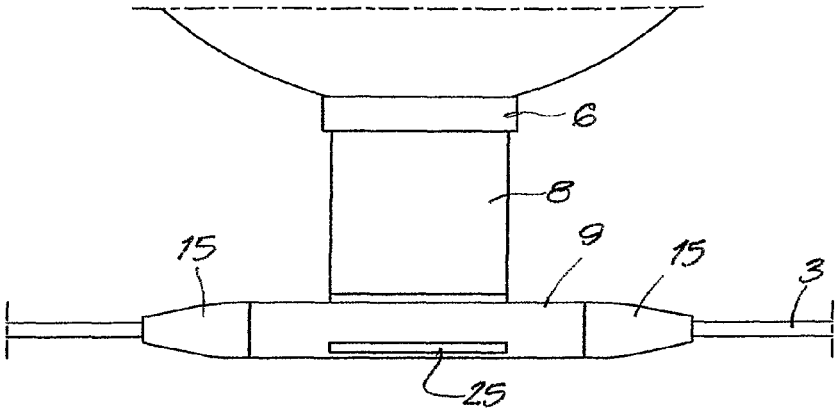
FIG. 4 shows a top view of FIG. 2 according to F4.
Figure 5:
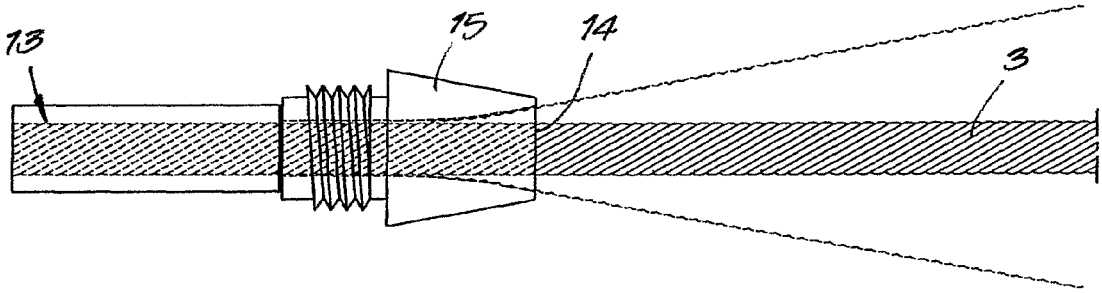
FIG. 5 shows a top view of a cable segment attachment feature according to F5 in FIG. 1.
Figure 6:
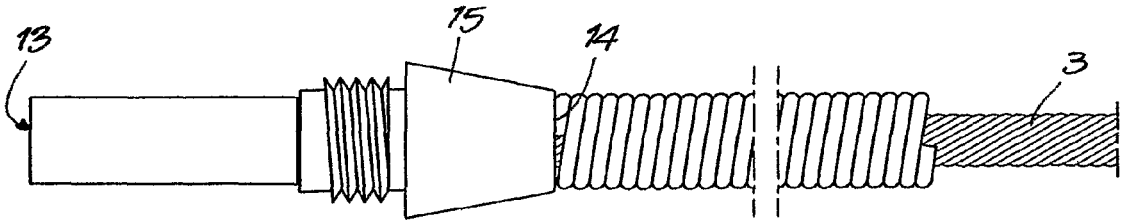
FIG. 6 shows the cable segment attachment feature according to FIG. 5 and a threaded stem around the belay line.
Figure 7:
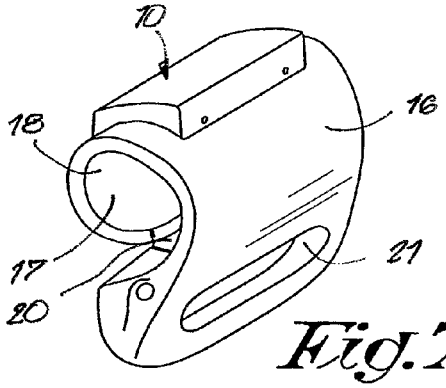
FIG. 7 shows a shuttle in perspective as an enlargement of F7 in FIG. 1.
Figure 8:
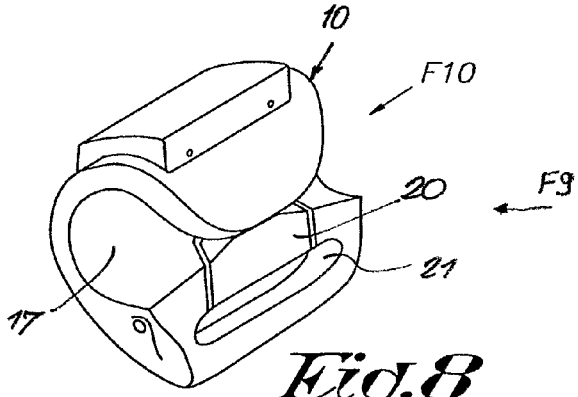
FIG. 8 shows a reverse view of FIG. 7.
Figure 9:
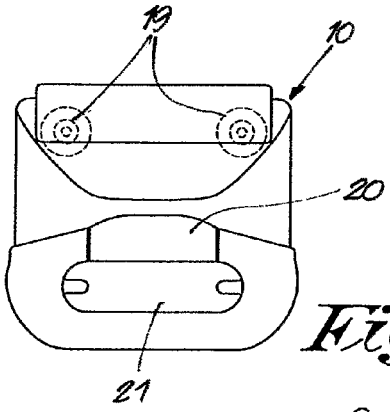
FIG. 9 shows a front view of FIG. 8 according to F9.
Figure 10:
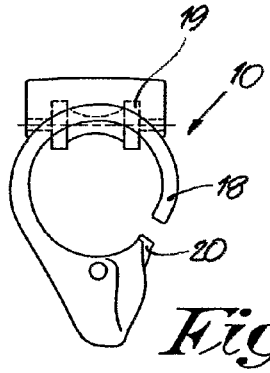
FIG. 10 shows a side view of FIG. 8 according to F10.

As shown in FIGS. 4, 5 and 6, the shuttle guide 9 is provided with stoppers 13, and internally threaded ends 14 and profile tips 15. The threaded ends 14 provide another modular feature for the fall arrest assembly 1. In particular, the threaded ends 14 are configured to accept a tapered profile tip 15 that is used to fasten a belay line segment 3 to the corresponding end 14 of the guide tube 15. In other words, rather than carrying a continuous belay line 3 throughout the entire length of the run of the fall arrest assembly 1, the run can be broken up into discrete belay line segments 3, with the segments 3 connected to each other through the shuttle guides 9. The belay line segments 3 can then be fixed behind the profile trip 15 with the stoppers 13 as shown in FIGS. 5 and 6.

The profile tip 15 is tapered at the outside so that the shuttle 10 may transit smoothly from the belay line 3 onto the shuttle guide 9 as the participant traverses each anchor station 4 of the fall arrest assembly 1.

The profile tip 15 preferably is also tapered on the inside so that the belay run may enter the profile tip under a slight angle but is guided longitudinally by the tapering to be in a centered position within the stopper 13. In other words, the opening of the profile tip increases from the inner threaded part to the free extremity.

The anchor stations 4 are configured to accommodate a wide range of shuttle designs, one example of which is shown in FIGS. 7 to 10.

The shuttle 10 is in the form of a generally C-shaped metal body 16 that defines a cable channel 17 through which the belay line 3 extends when the shuttle 10 is slidably mounted thereon. An entry slot 18 communicates with the channel 17 and provides a means for placing the shuttle 10 onto a belay line 3. Rollers 19 may advantageously be mounted within the cable channel 17 to facilitate the travel of the shuttle along the belay line 3.

The entry slot 18 is substantially closed by a gate 20 to prevent unanticipated release of the shuttle 10 from the belay line 3. Preferably the gate 20 is spring-biased relative to the shuttle body 16 to a position substantially closing the entry slot 18.

The gate 20 leaves enough of the entry slot 18 open so that the shuttle 10 can traverse the guide tube 13 of each shuttle guide 16. A portion of the gate 20 extends into a karabiner slot 21 formed in the body 16 so that the gate 20 cannot be moved from its closing position when a karabiner clip is positioned within the slot 21. When the karabiner slot 21 is empty, the gate 20 may be moved against the spring bias to allow placement of the shuttle 10 over a cable or rope 3.

The shuttle 10 is preferably formed of a high strength material, such as steel, so that it does not deform or fracture under the weight of the user, even when the shuttle 10 and belay line 3 support the user entirely following an accidental fall. The cable channel 17 is sized to permit easy passage over the shuttle guides 9 of the fall arrest assembly 1. Additionally, a bumper (not shown in the figures) may be mounted on the sides of the shuttle body 16 to prevent contact damage to the shuttle 10 along the belay line course.

In FIG. 1, the support extension 8 essentially consists of a support box 22 mounted perpendicularly on the mounting plate, the sides of which are preferably near-rectangular in shape and welded to the mounting plate 6 and the front of which is a support lid 23 which may be detachable by screws 24. This offers the advantage that the box 22 effectively forms a chamber over the anchor elements 11, protecting them from environmental or other possible outside impact.

The shuttle guide 9 is connected to the support box 22 of the support extension 8 by a support profile 25, which is preferably welded with a lower part 26 to the underside of the box 22. This profile 25 may or may not partly extend through the tubular part of the shuttle guide 9. The lower part 26 provides additional strength and resistance against metal fatigue.

Figure 11:
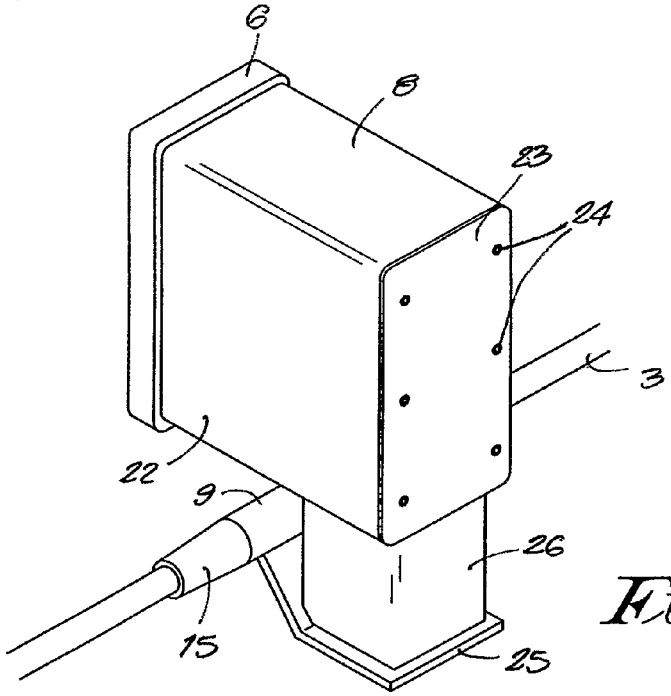
FIG. 11 shows an inside variant of the support extension.

In FIG. 1, the profile 25 points away from the object 2 in such a way that the shuttle guide 9 is situated in front and underneath of the support extension 8. It is a characteristic of the assembly 1 that different orientations of the profile 25 are possible. FIG. 11 shows that the profile 25 is pointed towards the object 2 such that the shuttle guide 9 is situated under the support extension 8. This will hereafter be referred to as the "inside" configuration, as opposed to the "outside" configuration depicted in FIG. 1.

Figure 12:
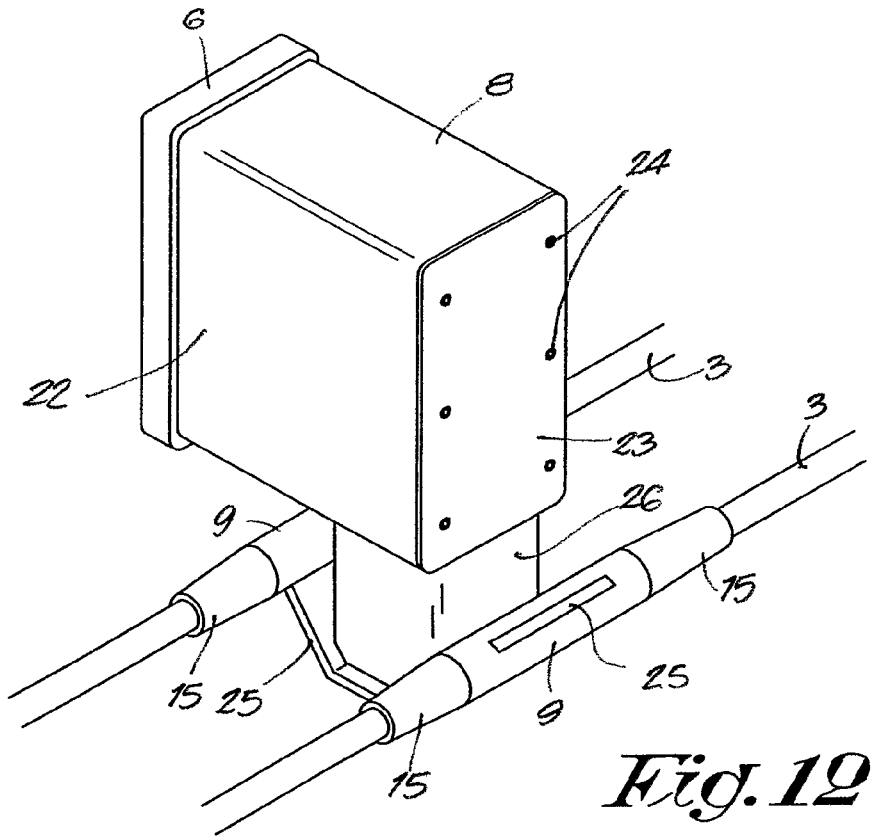
FIG. 12 shows a double-sided variant of the support extension.

In a preferred embodiment, shown in FIG. 12, two belay lines 3 pass through the anchor station 4, one "inside" and one "outside" of the support extension 8. In FIG. 12 this is represented by a moat-like profile 25 welded by the lower part 26 to the support box 22. This essentially provides a strong and compact structure, with the added advantage that an accidental fall can be arrested by two instead of one belay lines 3. Another possibility is that one belay line 3 is provided per person, implying that two participants can be one and the same element.

Figure 13:
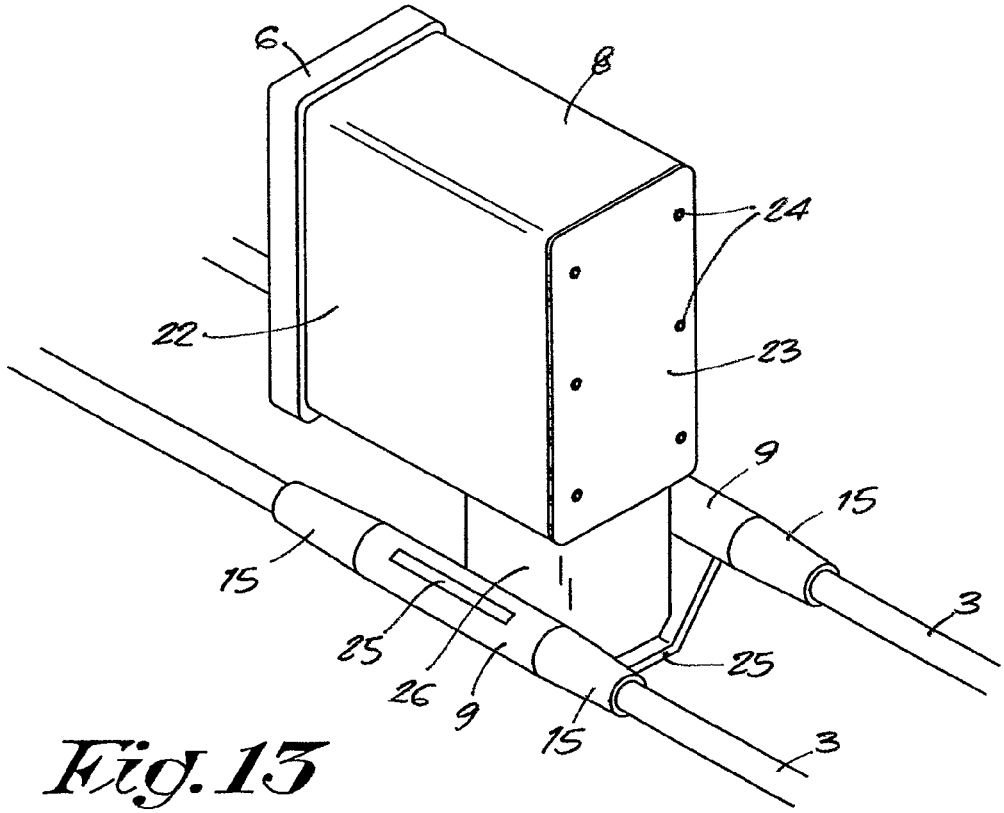
FIG. 13 shows another double-sided variant of the support extension.

In all these cases the belay lines 3 run more or less parallel with the plane of the mounting plate 6, but other variants are possible. FIG. 13 shows a variant where the belay lines 23 run more or less perpendicularly to the plane of the mounting plate 6. As will be explained below, these support extensions 8 can be employed to carry the support guides of transfer stations and descend stations.

Figure 14:
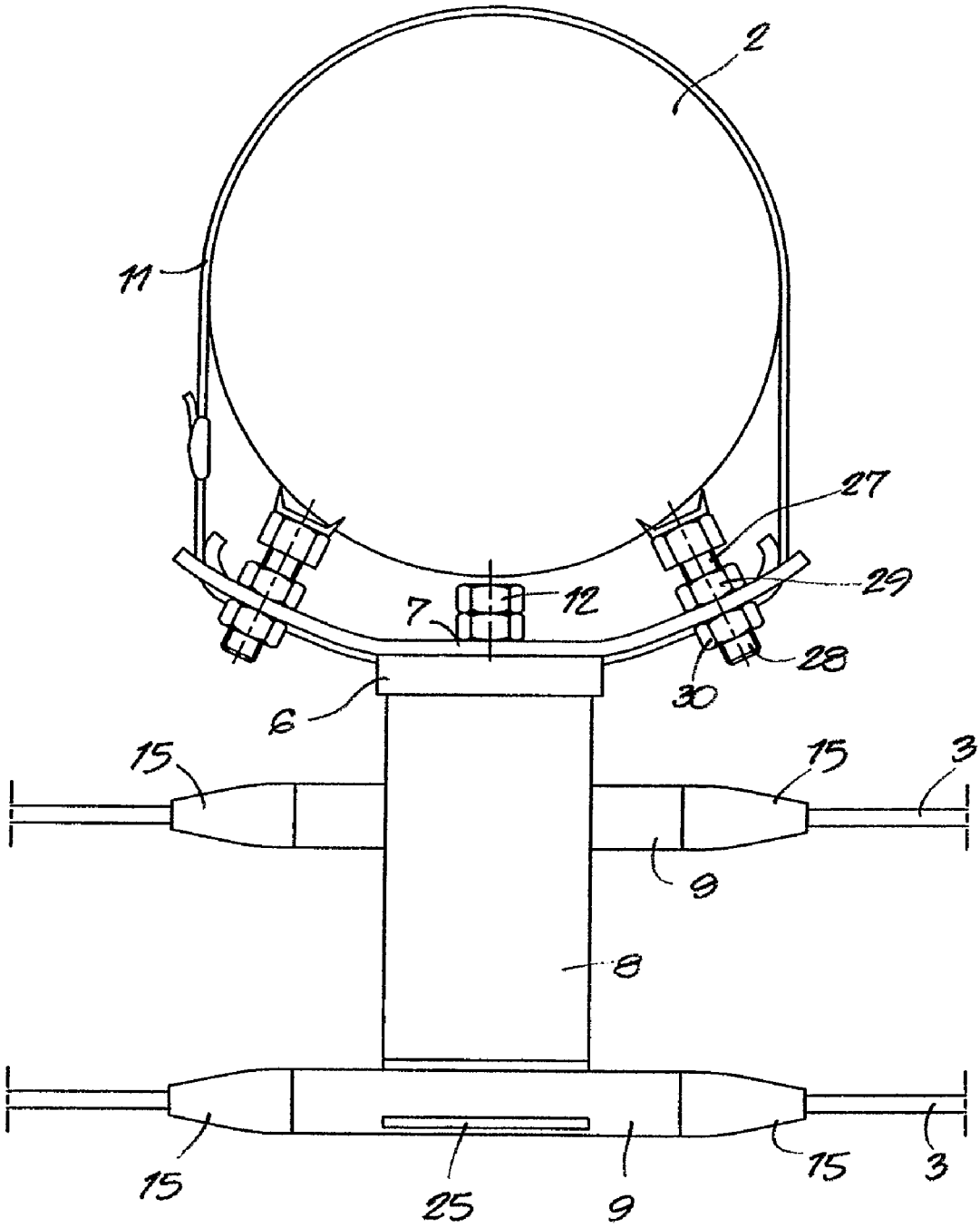
FIG. 14 shows a top view of the fall arrest assembly provided with spacers to clamp around the object.

As shown in FIGS. 1 to 4 and FIGS. 11 to 13, the mounting plates 6 have the anchor openings 7 defined vertically along the centreline. It is not excluded however, as shown in FIG. 14, that the plates 6 further include wings with openings 7 at each side of the central portion and arranged at an angle relative to the central portion so that the plates 6 exhibit a flexibility to be accurately mounted to a generally cylindrical vertical object 2, such as a tree or a post.

Particularly in the case of trees however, the object will be irregularly cylindrical and the mounting plates 6 are therefore unlikely to correspond exactly to the shape of the object 2. In these cases, the anchor stations are additionally provided with spacers 27 as shown in FIG. 14. The spacers 27 are preferably adjustably attached to the mounting plates so that the side-to-side position, of the spacers 27 may be adjusted. Moreover, the spacers 27 are preferably configured to permit in and out adjustment to conform to irregularities in the surface of the object 2.

The spacers 27 preferably include an adjustable mounting bolt arrangement, akin to a height adjustment mechanism for a table or chair. Thus, the spacers 27 may include a head 28 with a threaded stem 29 projecting therefrom, as shown in FIG. 14. Nuts 30 are threaded onto the stem 29 on opposite sides of the plate 6 with the stem 29 extending through an opening 7 in the mounting plate 6. The anchor elements 11 can hereby pierce through the object 2, but in FIG. 14 the anchor elements 11 effectively are a couple of belts attached and tightened around the object 2. This set-up is suited for objects which are difficult or not suited at all for piercing through.

Thus, when the mounting plate 6 is initially mounted to the vertical support using the anchor elements 11, the position of the head 28 of each spacer 27 may be adjusted in and out and from side to side with the nuts 30 initially loose. When the spacer 27 is properly positioned it will place the anchor elements 11 under tension to strengthen the mounting of the anchor station 4 to the object 2. The nuts 30 may then be fully tightened to firmly clamp the spacers 27 to the mounting plate 6.

It should be emphasized that the mounting plates 6 include a sufficient number of openings 7 to accommodate multiple anchor positions for the anchor station 4. Preferably four openings 7 are provided in a vertical row but it is possible that the anchor station 4 may be solidly anchored to the object 2 using only two anchor elements 11. Thus, only two of the four holes 7 may receive a corresponding anchor element 11. When only one anchor element 11 is used to anchor on a given object 2, the anchor elements 11 may extend through any of the openings 7. However, in other arrangements, at least two anchor elements 11 must be mounted to an object 2, like in the case when the belay line is travelling around or inside a corner and the anchor elements 11 pierce through the object 2.

Figure 15:
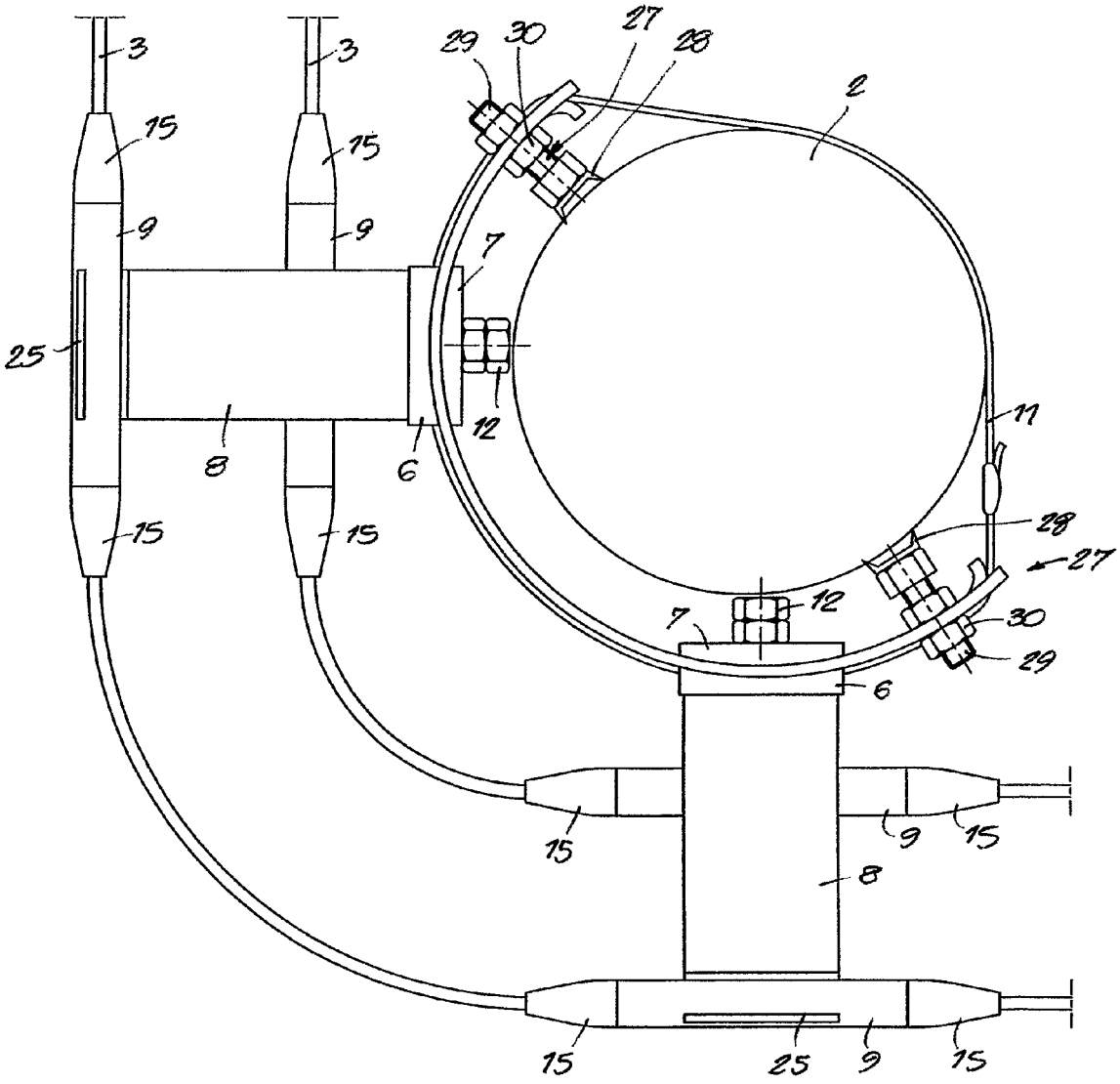
FIG. 15 shows a top view of the fall arrest assembly forming an outside corner around the object.

Another possibility for travelling around a corner is shown in FIG. 15 where the anchor element is a belt which can be used to anchor multiple anchor stations 4. Here the use of a single anchor element 11 is possible, but in most cases multiple anchor elements 11 will be used for safety reasons.

Figure 16:
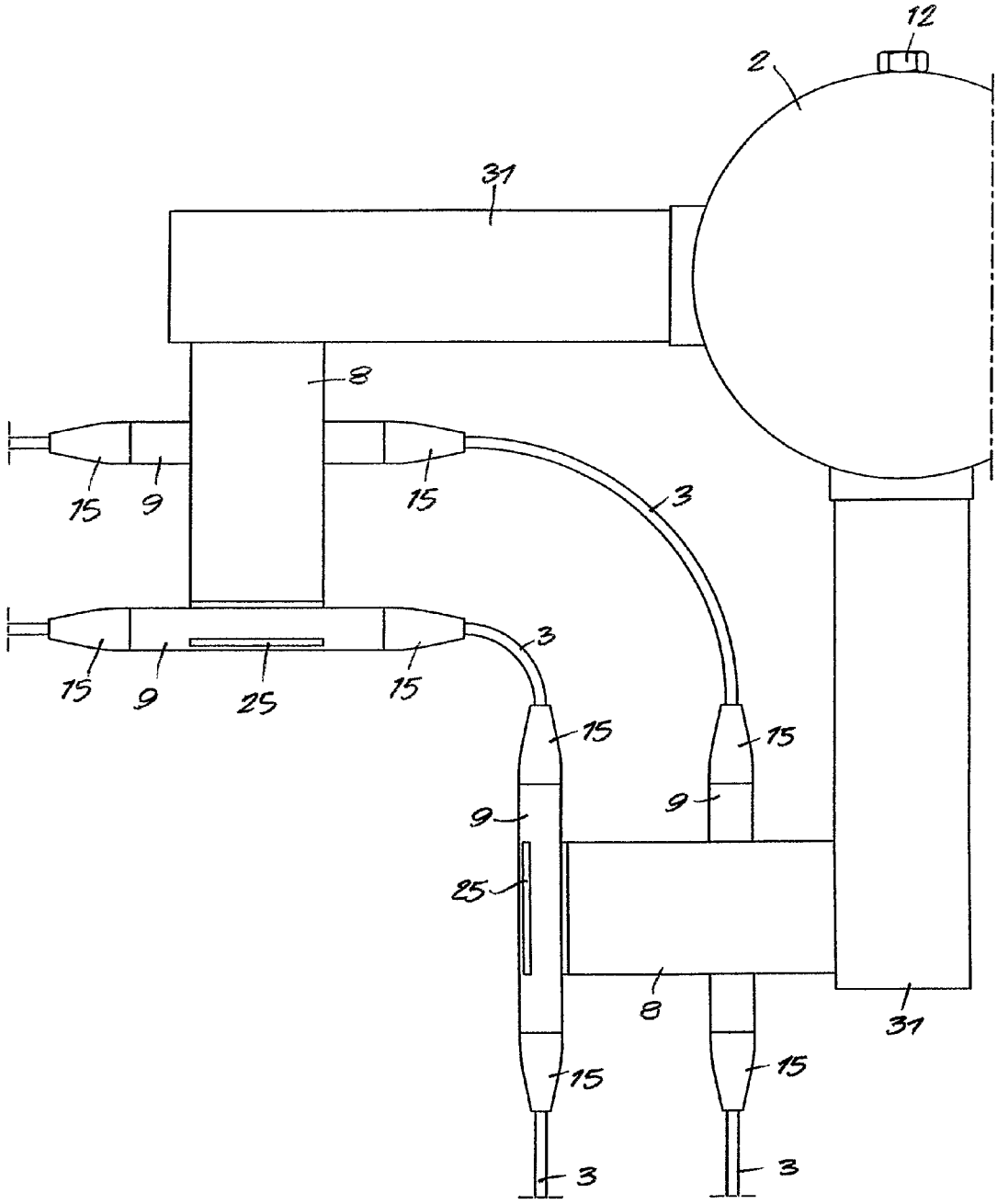
FIG. 16 shows a top view of the fall arrest assembly forming an inside corner around the object.

FIG. 16 shows a configuration wherein the fall arrest assembly 1 takes an inside corner. Multiple anchor elements 11 are employed here because they pierce through the object 2. It is also imperative here that the support extension 8 is essentially a cornerpiece. One could say that in this configuration the support box 22 is welded or fixed to an additional extension part 31 so that the belay lines can take the corner inside of the object 2.

Figure 17:
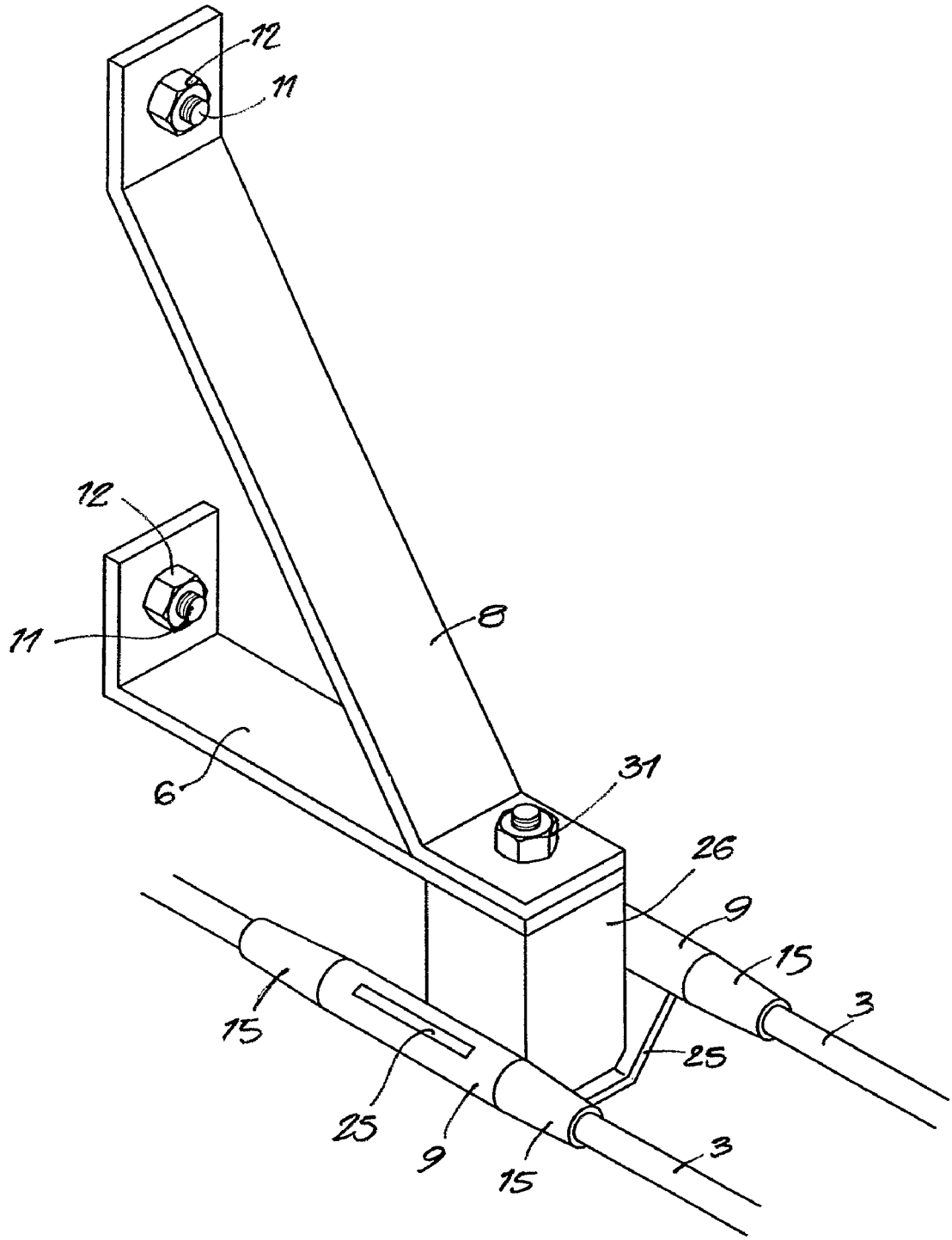
FIG. 17 shows a variant of the mounting plate and support extension.
Figure 18:
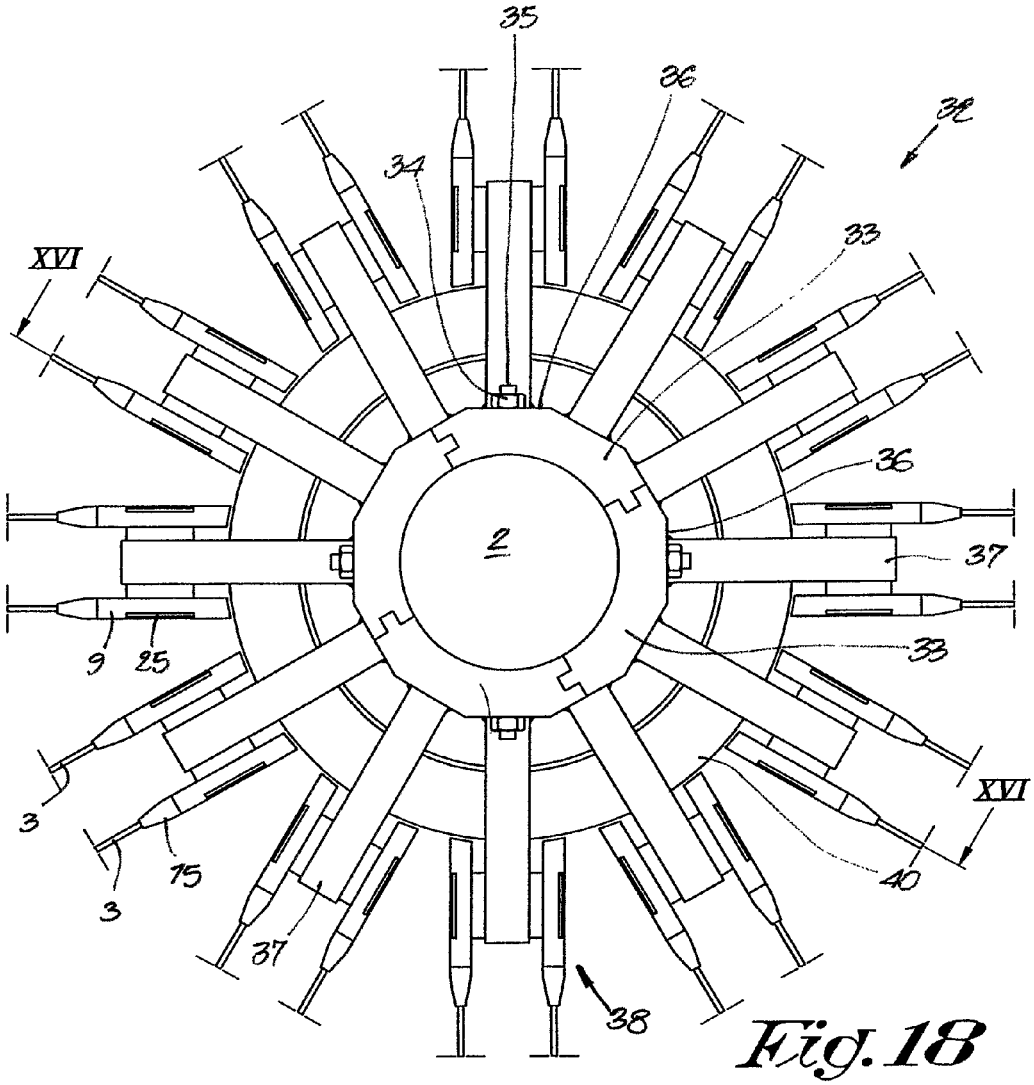
FIG. 18 shows a top view of a shuttle transfer station.
Figure 19:
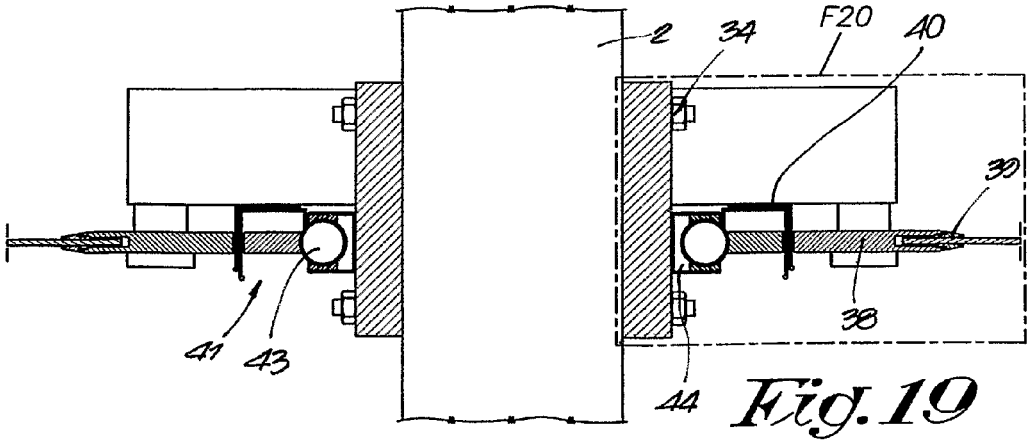
FIG. 19 shows a side view of FIG. 18 according to line XVI-XVI.

While some preferred embodiments have been described above, it is not excluded that the mounting plate 6 and support extension 8 can vary in shape and interaction. For instance, in FIG. 17 two mounting plates 6 of different shape are used. Indeed, one would rather say they are profiles, and the support extension 8 is hereby restricted to a profile 25 and brackets 26 bolted directly onto the mounting plates 6 with bolts 31. This can be useful for anchor stations 4 where less support is required and where a simplified ad hoc solution suffices.

In a further embodiment of the invention, the ability to transfer a belay line shuttle 10 between unconnected belay lines 3 is proposed.

FIGS. 18 to 21 show a transfer station 32 attached to an object 2. The transfer station 32 is preferably accompanied by a platform (not shown in the figures) on which the participant stands while effecting the transfer of the shuttle 10 between the belay line runs. As shown in more detail in FIG. 20, the transfer station 32 includes a mounting plate 33 that is similar to the mounting plate 6 of the embodiment shown in FIG. 2. The mounting plate 33 includes a plurality of mounting openings 34 that accept anchor elements 35 such as the elements 11 shown in FIG. 2 and which are configured for strap mounting of the plate 33 to the object 2. Unlike the mounting plate 6, however, the mounting plate 33 is formed of multiple adjoining facets 36, composing a regular polygon around the object 2 when viewed from above as in FIG. 18. To each facet 36 a support flange 37 is mounted. Consequently, each facet 36 includes shuttle guides 38 disposed at relative angles to each other. In particular, each shuttle guide 38 is essentially perpendicular to the facet 36 it faces.

The outboard end of each shuttle guide 38 includes a profile tip 39 that fixes a belay line 3 to the shuttle guide 39 in the same manner as to the shuttle guides 9 described.

In this way, each shuttle guide 38 interfaces with a different belay line run and different belay lines unconnected with each other.

In order to transfer the safety shuttle 10 between these cable runs, the transfer station 32 further comprises a rotating barrel 40.

Figure 21:
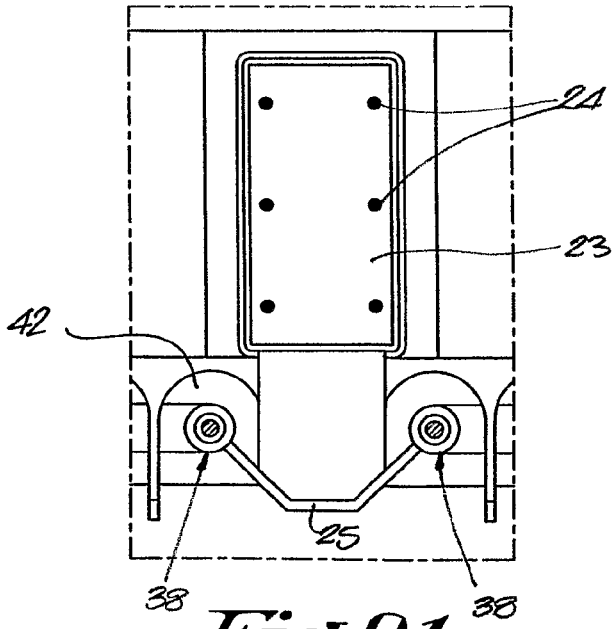
FIG. 21 shows a front view of FIG. 20 according to F21.

The barrel 40 includes segments 41 which define a pass-through slot 42 that permits passage of a shuttle 10 through the barrel 40. In one aspect of the invention, the rotating barrel 40 is provided with its own transfer shuttle guide 43 that is supported on the inside of the barrel by a flange 44. The transfer shuttle guide 43 is oriented so that its ends face the openings of the pass-through slot 42, as shown in FIG. 21.

It can be readily appreciated that when the barrel 40 is rotated to one position, the slot 42 will face a selected one of the shuttle guides 38 associated with one of the belay line runs. Consequently, the transfer shuttle guide 43 will also be aligned with the belay line shuttle guide 38 so that a shuttle 10 travelling on that line 3 may be easily transferred onto the transfer shuttle guide 43. Once the shuttle 10 is positioned on the transfer shuttle guide 43, the barrel 40 may be rotated until one of the openings 42 and transfer shuttle guide 43 are facing another outboard shuttle guide 38. The shuttle 10 may then be transferred onto another cable run line 3.

Figure 22:
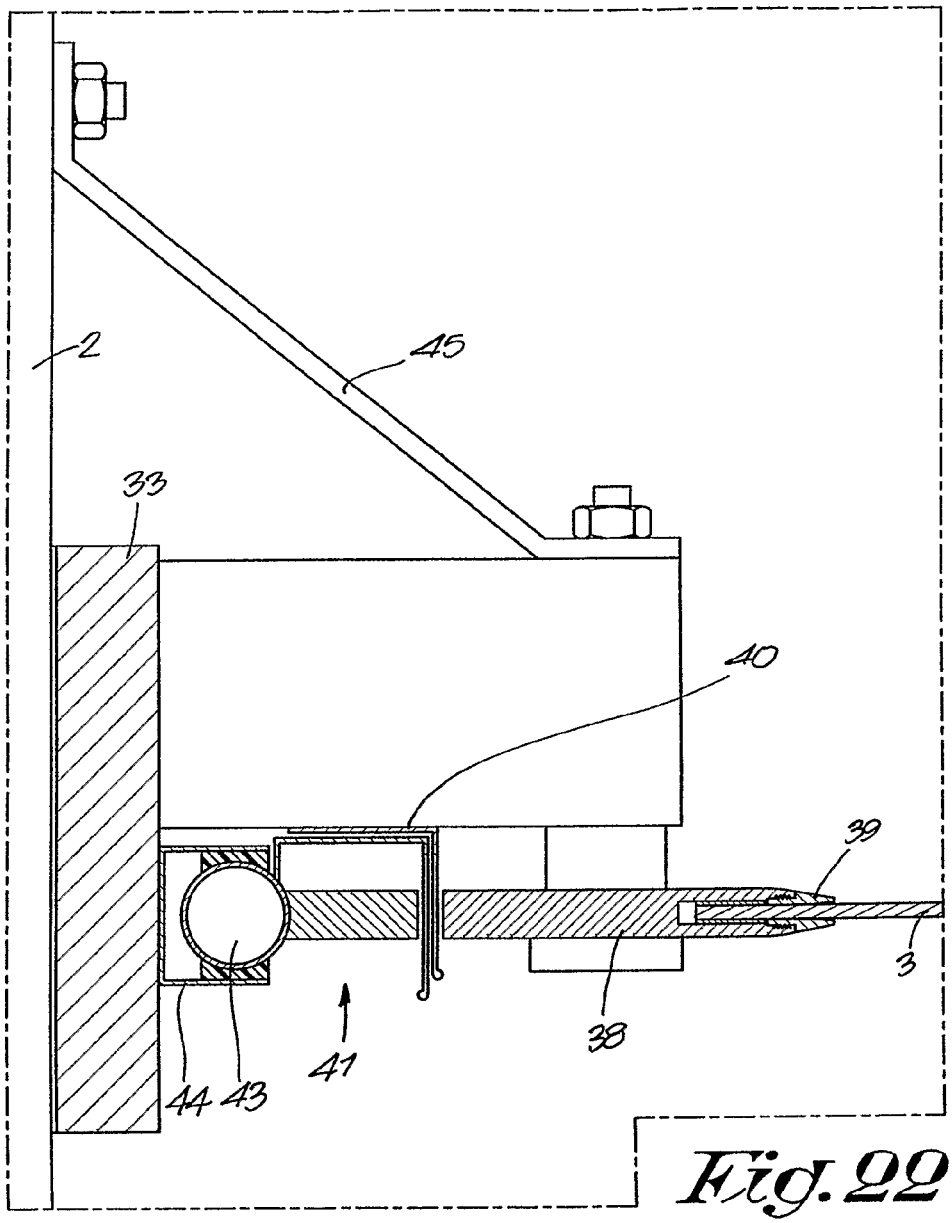
FIG. 22 shows a variant on FIG. 19.
Figure 23:
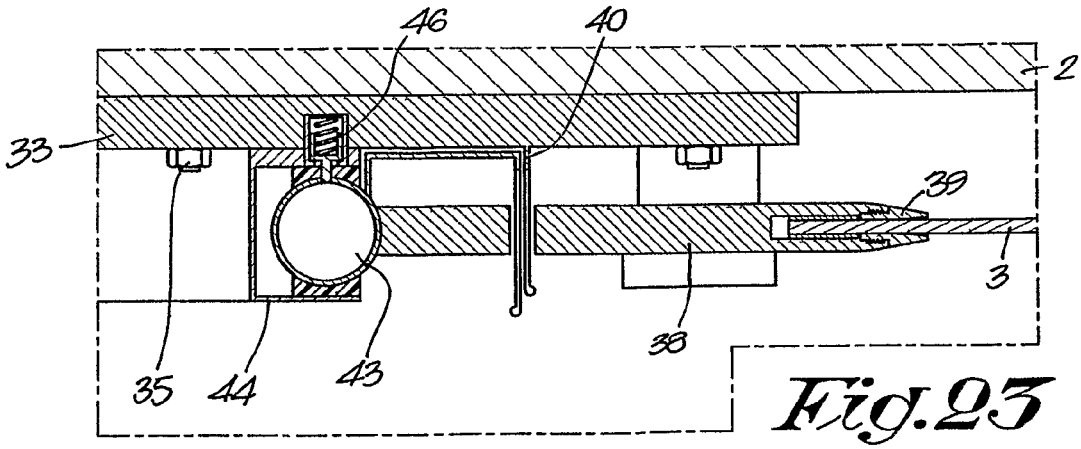
FIG. 23 shows another variant on FIG. 19.

As with the variants given above for the mounting plate 6 and support extensions 8, similar variants can also be conceived to provide further support or to offer solutions to specific environments. In FIG. 22 an additional mounting frame 45 is employed. In FIG. 23 the mounting plate 33 is mounted underneath an object 2 rather than at its side. Optionally spacers 24 can also be included in the set-up of the transfer station 32.

Figure 20:
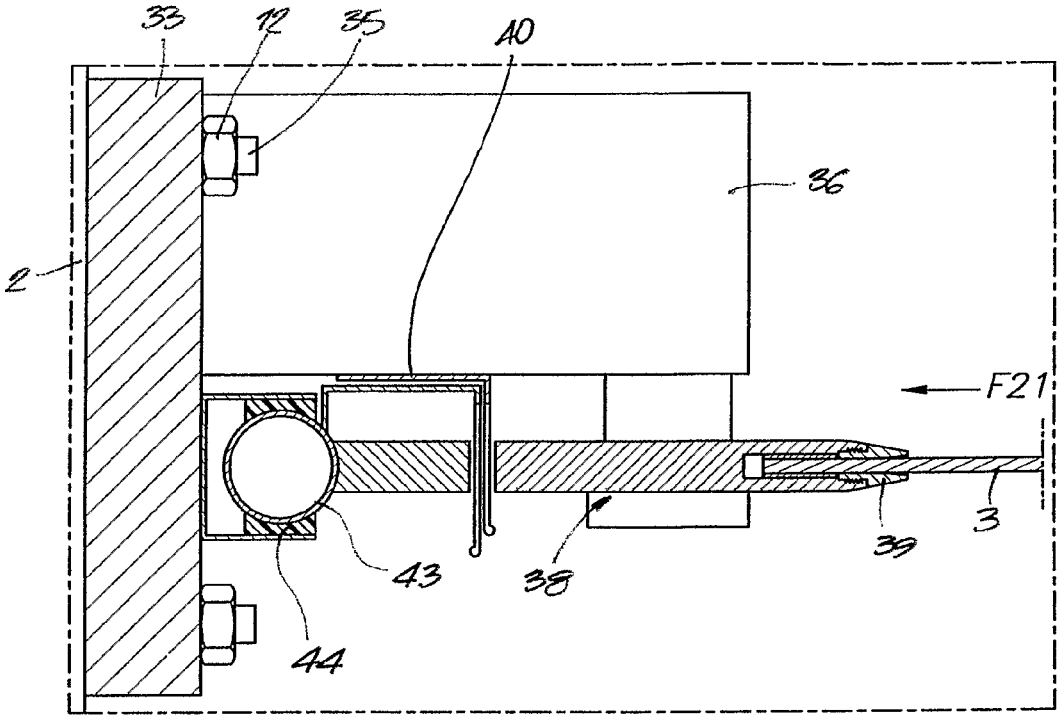
FIG. 20 shows an enlargement of FIG. 19 according to F20.
Figure 24:
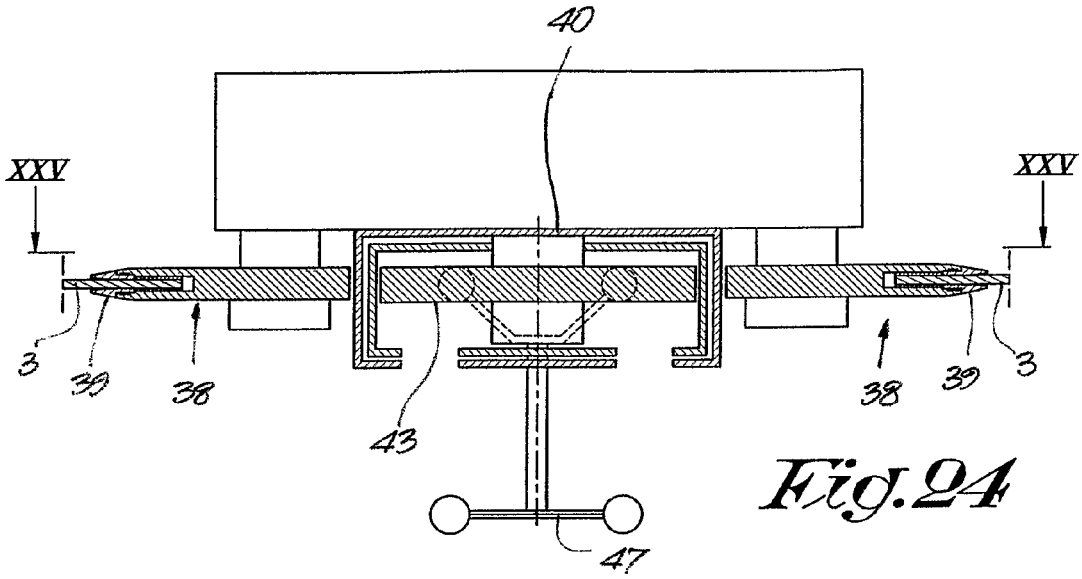
FIG. 24 schematically shows a side view of a variant of a shuttle transfer station.

FIGS. 20, 23 and 24 also show an optional pin and spring mechanism 46 that allows the rotating barrel 40 to be positioned in line with the respective shuttle guides 38 and prevents shuttle 10 from leaving the pass-through slot 42 once it has entered the rotating barrel 40 until the next shuttle guide 38 has been reached.

Optional features not shown in the figures are electrical locking mechanisms or computer chips provided with counters or timers in order to, for example, keep track of how many participants have passed the transfer station 32 or at what time.

Figure 25:
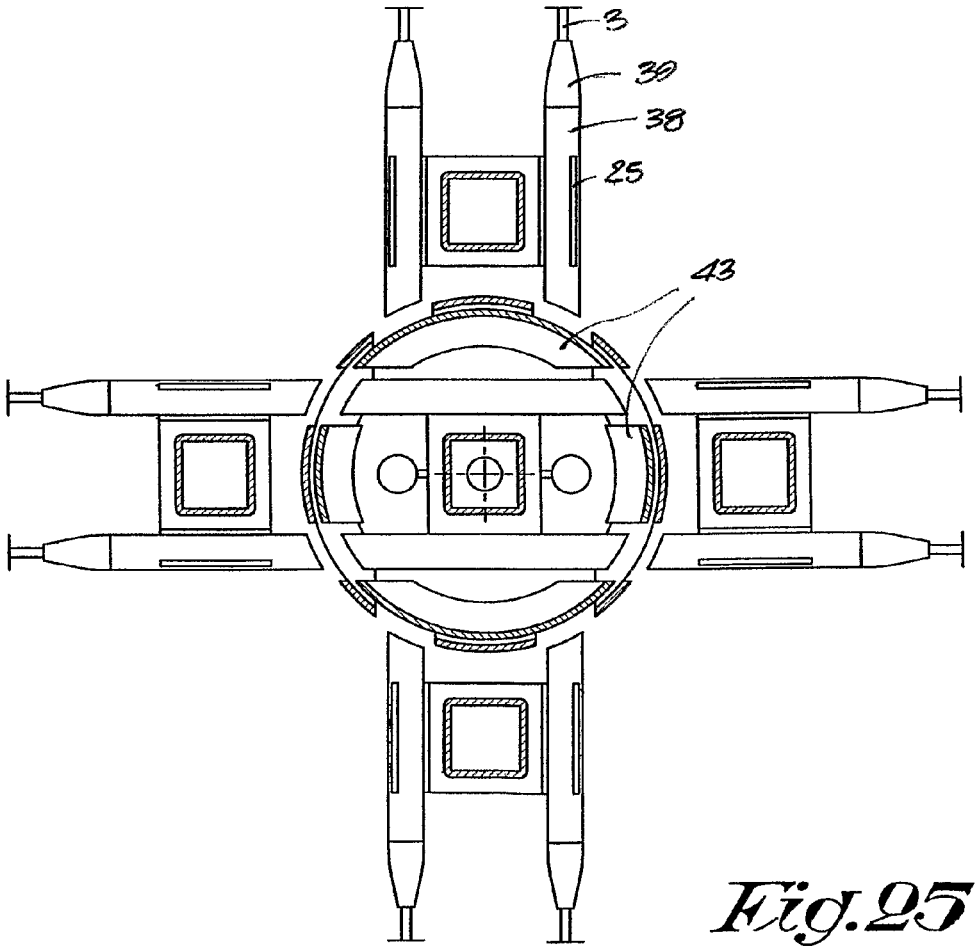
FIG. 25 shows a top view of FIG. 24 according to line XXV-XXV.

FIGS. 24 and 25 show that the rotating barrel 40 may also include a pair of handles 47 at its lower end that may be grasped by the user to rotate the barrel 40.

The rotating barrel 40 can be a tube or plate meaning sizes and forms can be different.

Figure 26:
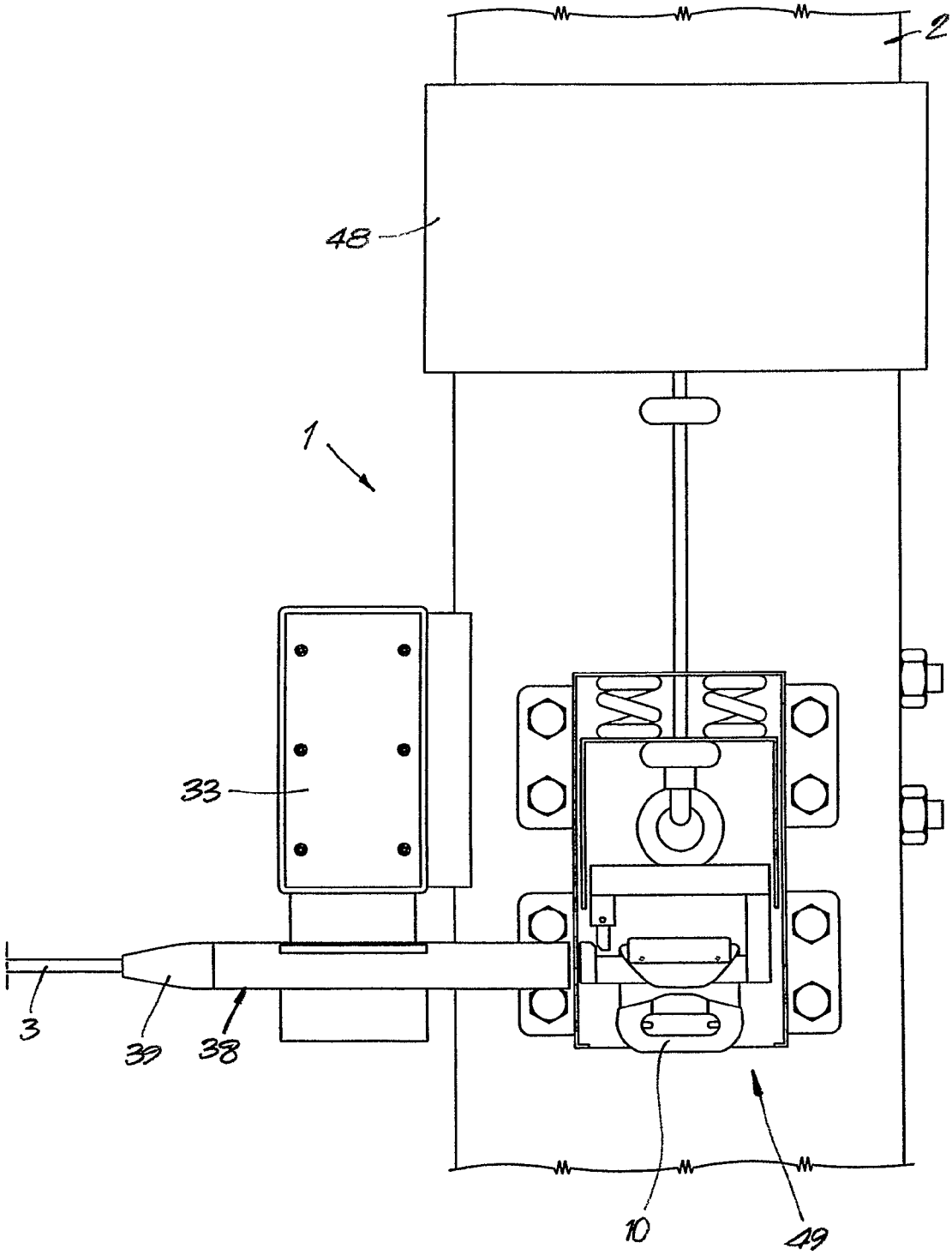
FIG. 26 shows a side view of a shuttle descend station.

In another aspect of the invention, the fall arrest assembly 1 can also comprise a descend station 48, as shown in FIG. 26.

The principle is the same as for a transfer station 32, namely allowing the uncoupling of a shuttle 10 from a belay line 3 by means of a shuttle guide 38 in order to transfer it to another position.

In the case of a descend station 48, however, the transfer takes place vertically, instead of horizontally, towards another shuttle guide 38 and belay line 3 or, in most cases, towards the ground where the participant can safely be uncoupled from the fall arrest assembly 1. This implies a descend shuttle guide 49 that is mounted vertically to an object 2 instead of a transfer shuttle guide 43 that is mounted horizontally around an object 2.

Figure 27:
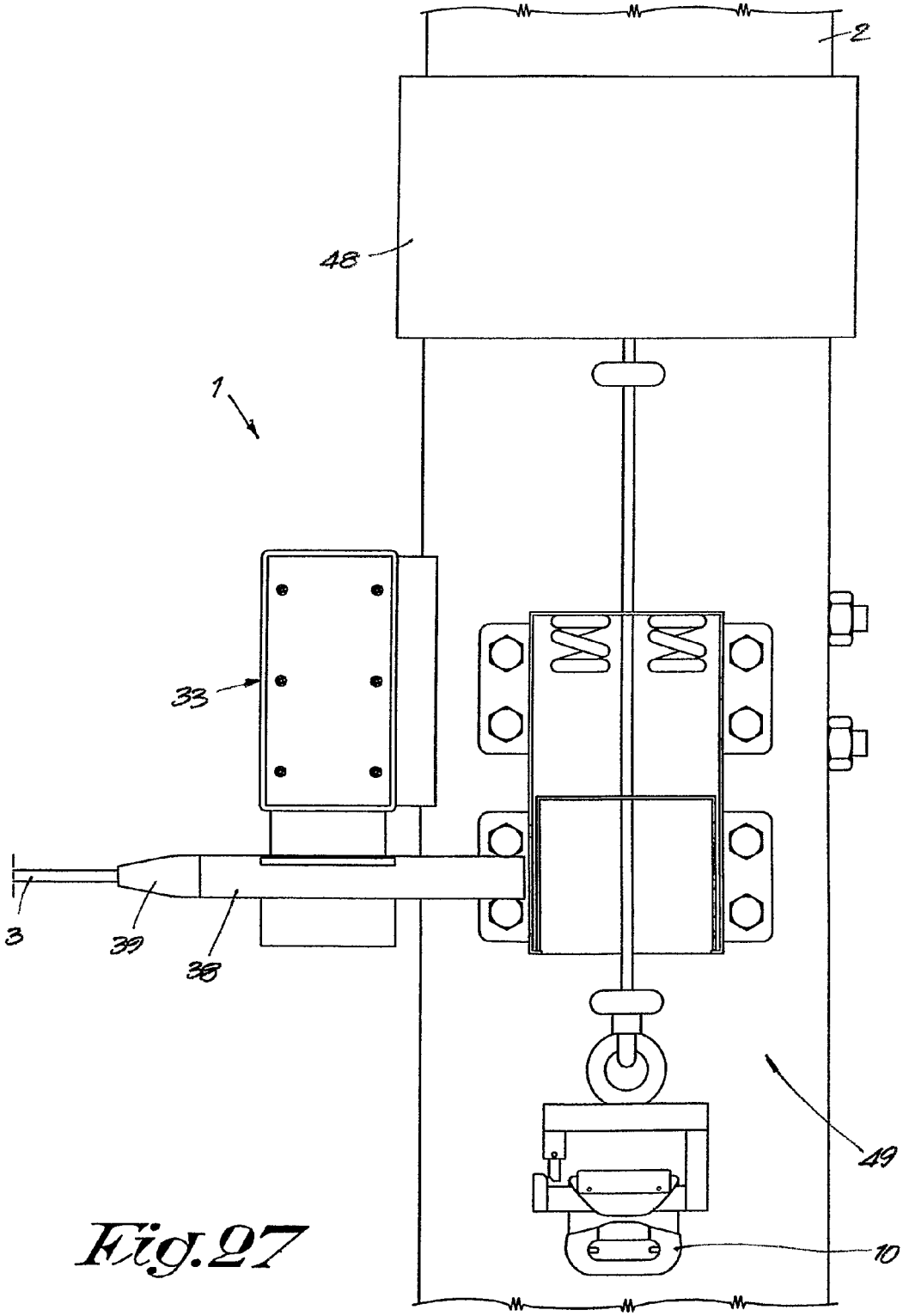
FIG. 27 shows a side view of a shuttle descend station whereby the shuttle is descending.

Since the principles for both stations are the same, FIGS. 26 and 27 are not explained in further detail and the same optional elements, such as sensors, locking mechanisms or spacers can be included.

Figure 28:
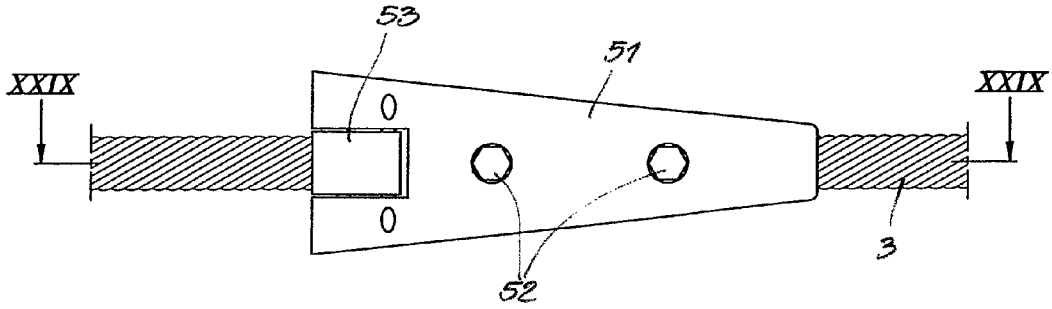
FIG. 28 shows a top view of arrest means.
Figure 29:
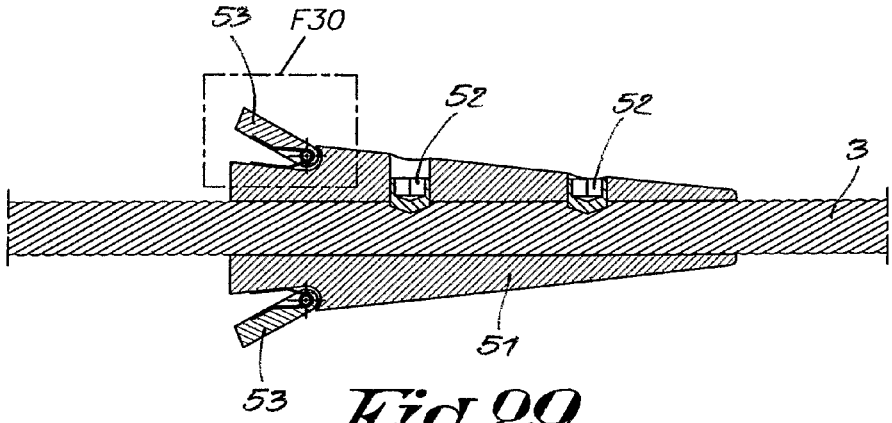
FIG. 29 shows a side view of FIG. 28 according to line XXIX-XXIX.
Figure 30:
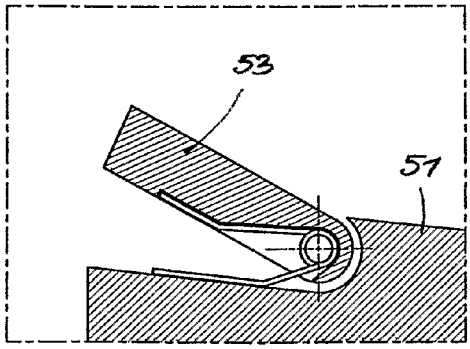
FIG. 30 shows an enlargement of FIG. 29 according to F30.

Another optional addition to the fall arrest assembly 1 is shown in FIGS. 28 to 30 where is shown that on the belay lines 3 themselves arrest means 49 are provided.

These arrest means 50 can come in handy when the belay lines 3 do not run horizontally but under a vertical angle.

The arrest means can for instance be provided in the form of a body 51 with bolts 52 that can be screwed against the belay line 3 to fix the arrest means 50 to the belay line 3.

The arrest means are further provided with clips 53 which are spring-biased away from the belay line 3 so that the shuttle 10 can easily pass in one direction but is prevented from passing in the other direction.

It is clear that the present invention is not restricted to the exact form described above for the different components of the fall arrest assembly, but that the components can come in different shapes and sizes.

Figure 31:
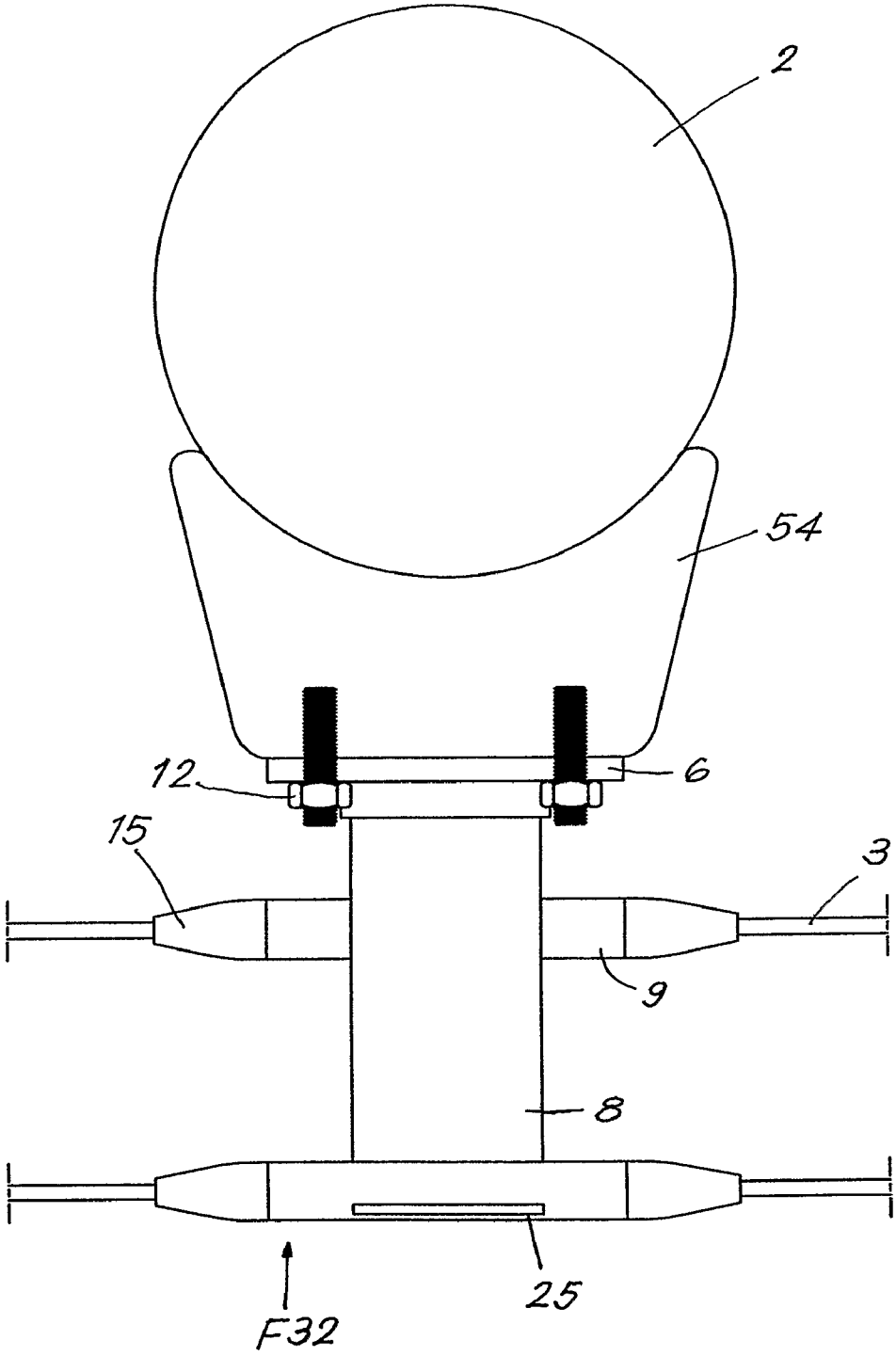
FIGS. 31 to 35 show variants on FIGS. 14 to 16.
Figure 32:
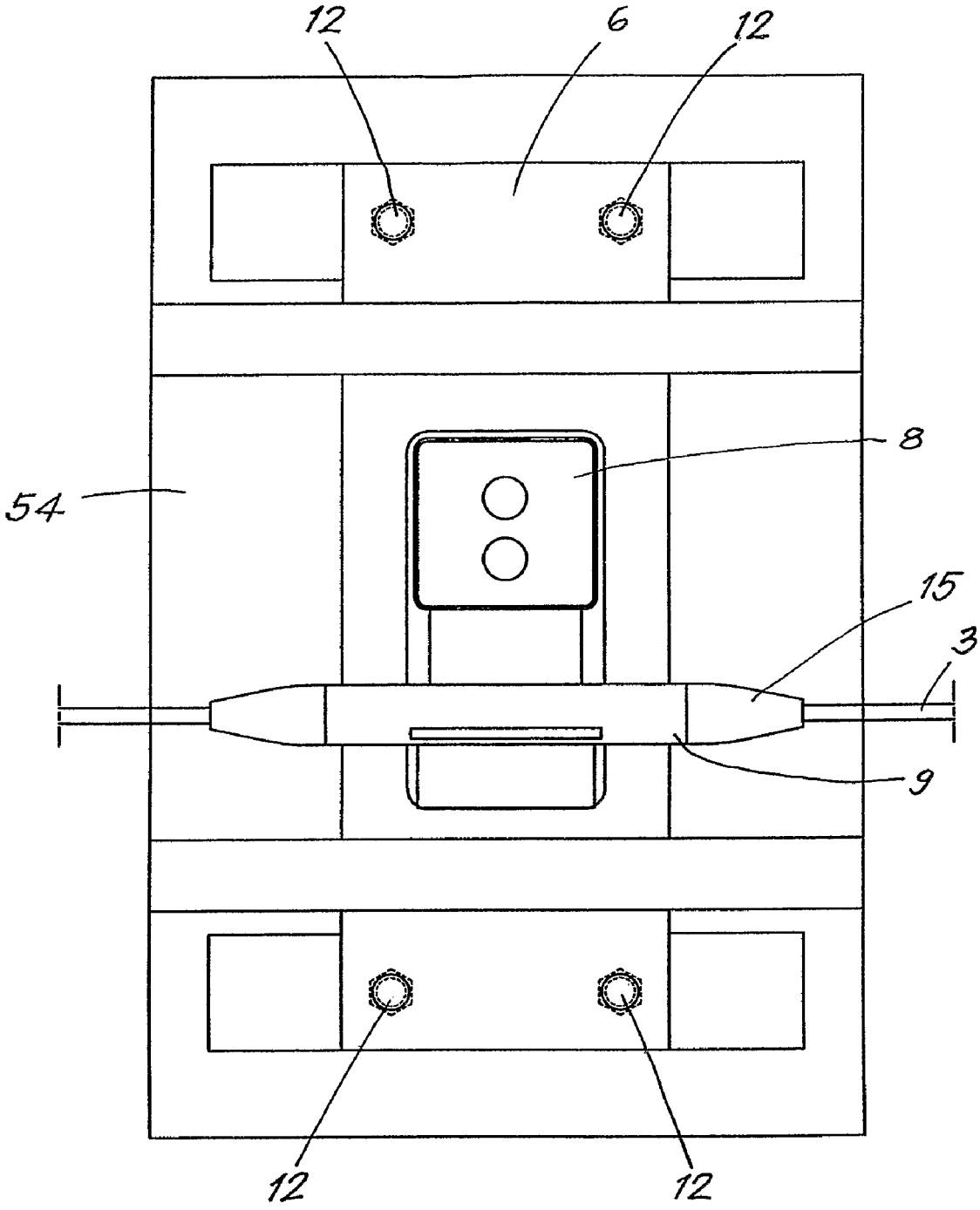

FIG. 31, for example, shows an alternative to the spacers 27 used in FIG. 14, whereby a plastic attachment part 54 is used to attach the mounting plate 6 around an object 2. This alternative can be used in situations where spacers 27 prove to be unsuitable or undesirable. FIG. 32 shows a front view according to F32 of FIG. 31.

Figure 33:
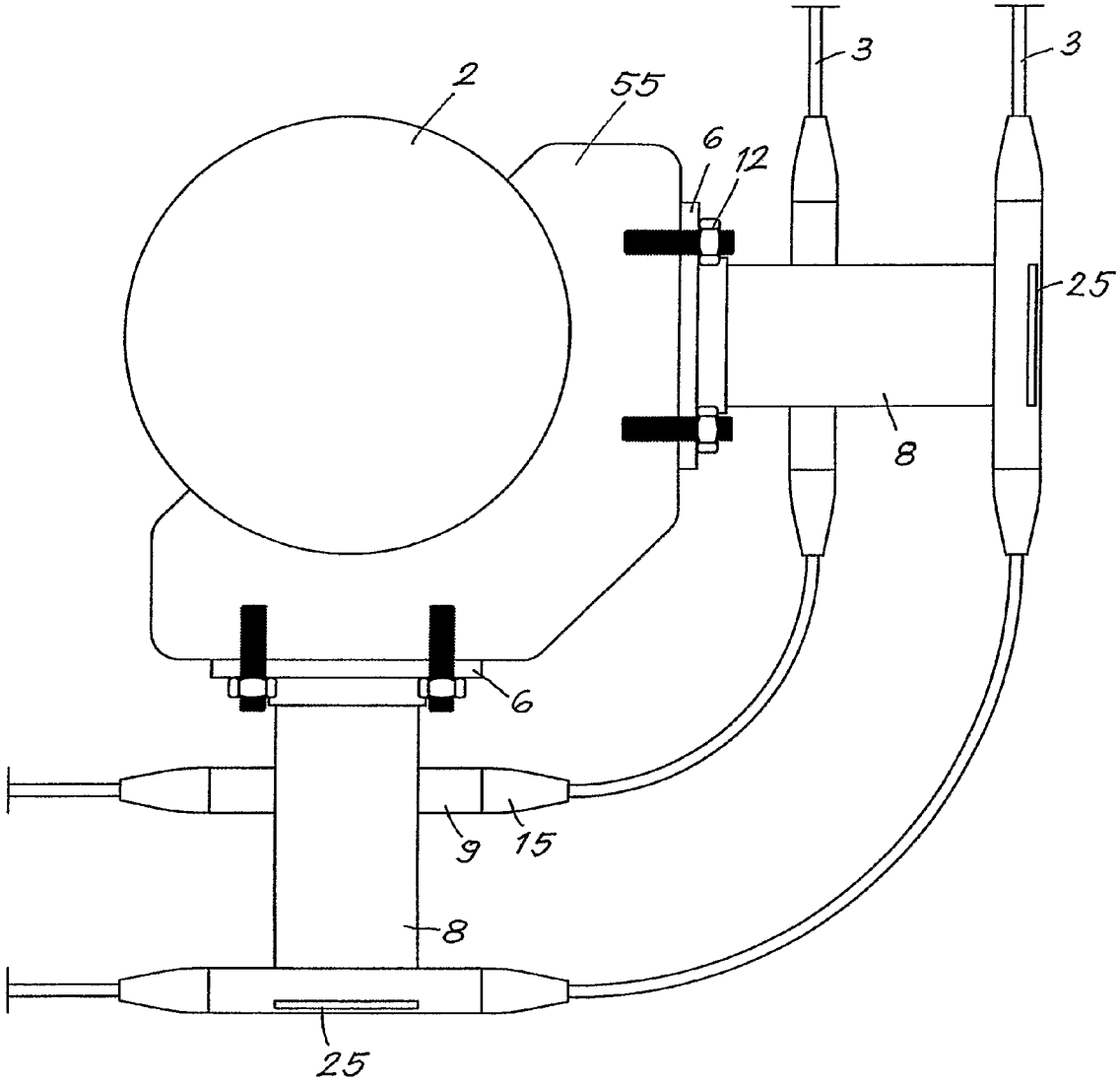
Figure 34:
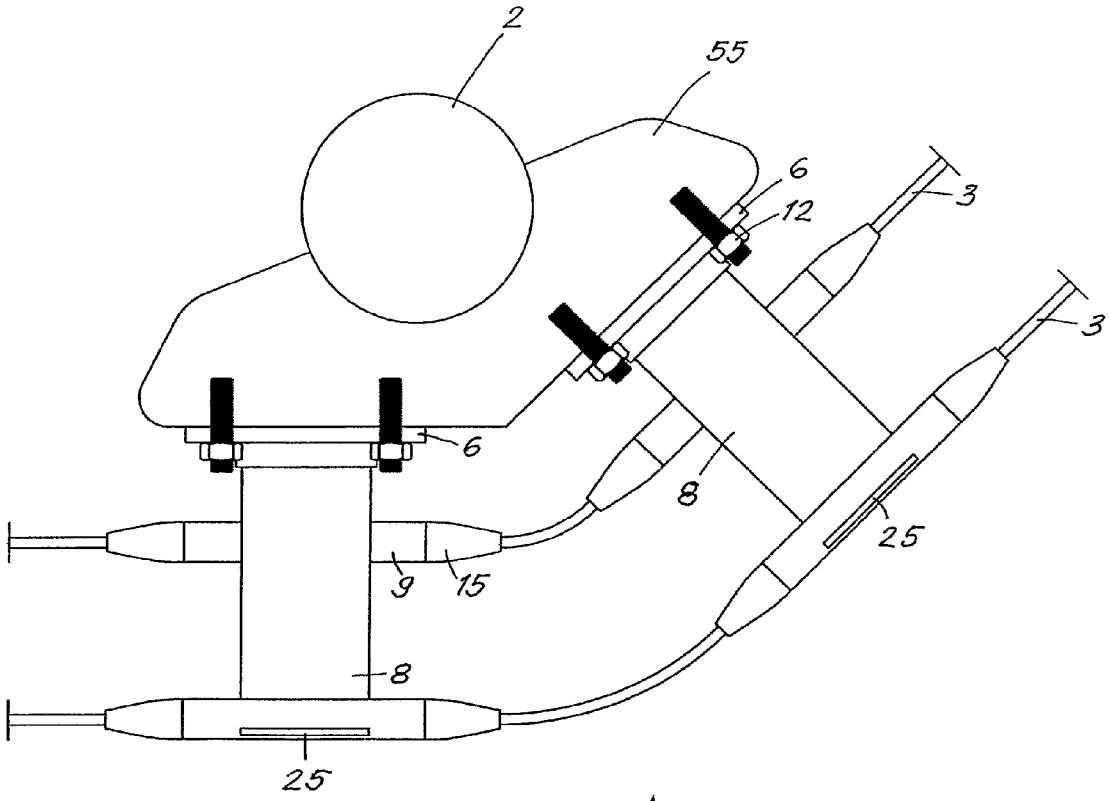
Figure 35:
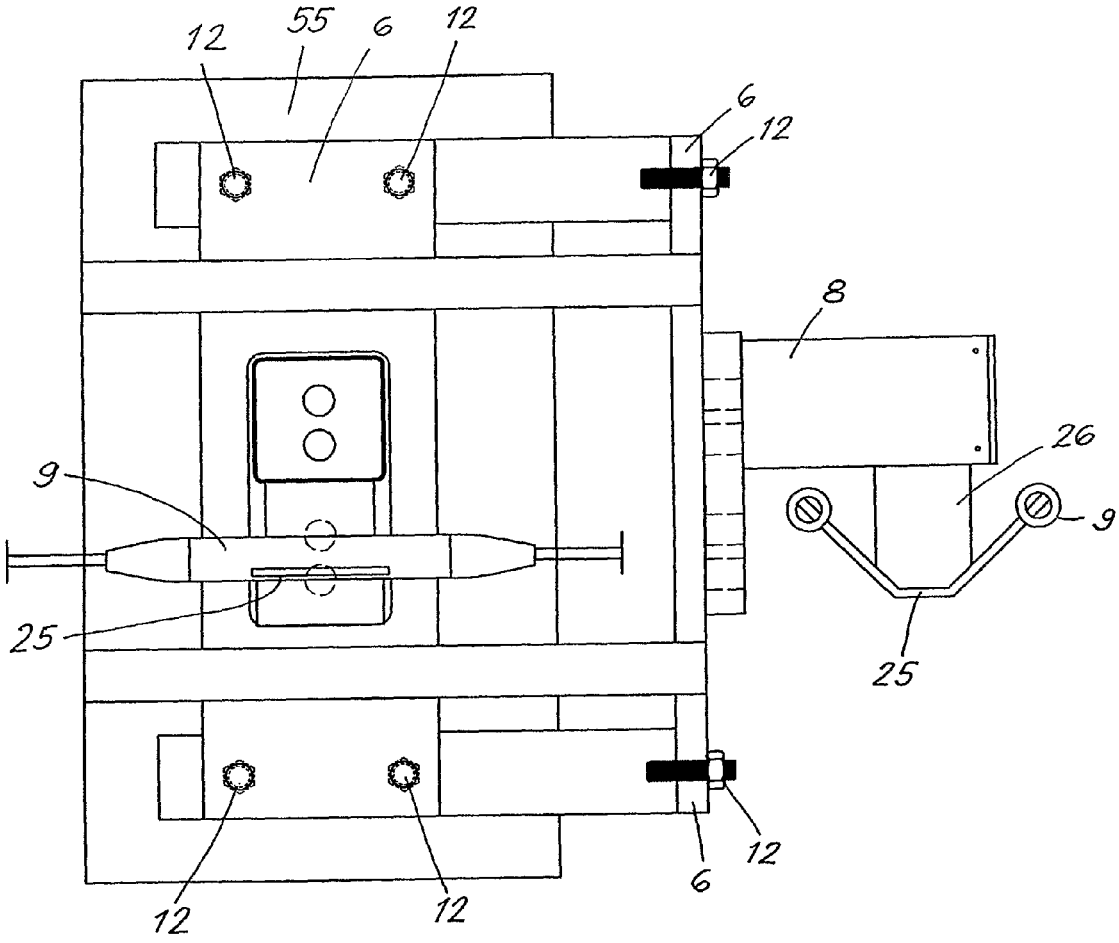

A similar plastic corner attachment part 55 can be used as an alternative to the spacers 27 used in FIG. 14 to attach two mounting plates 6 in order to take a corner around an object 2, as shown in FIG. 33. This plastic corner attachment part can come in different shapes, as shown in FIG. 34, wherein a corner of a different angle is taken around said object 2. FIG. 35 shows a front view of FIG. 34 whereby the belay lines 3 have been omitted for the sake of clarity.

Figure 36:
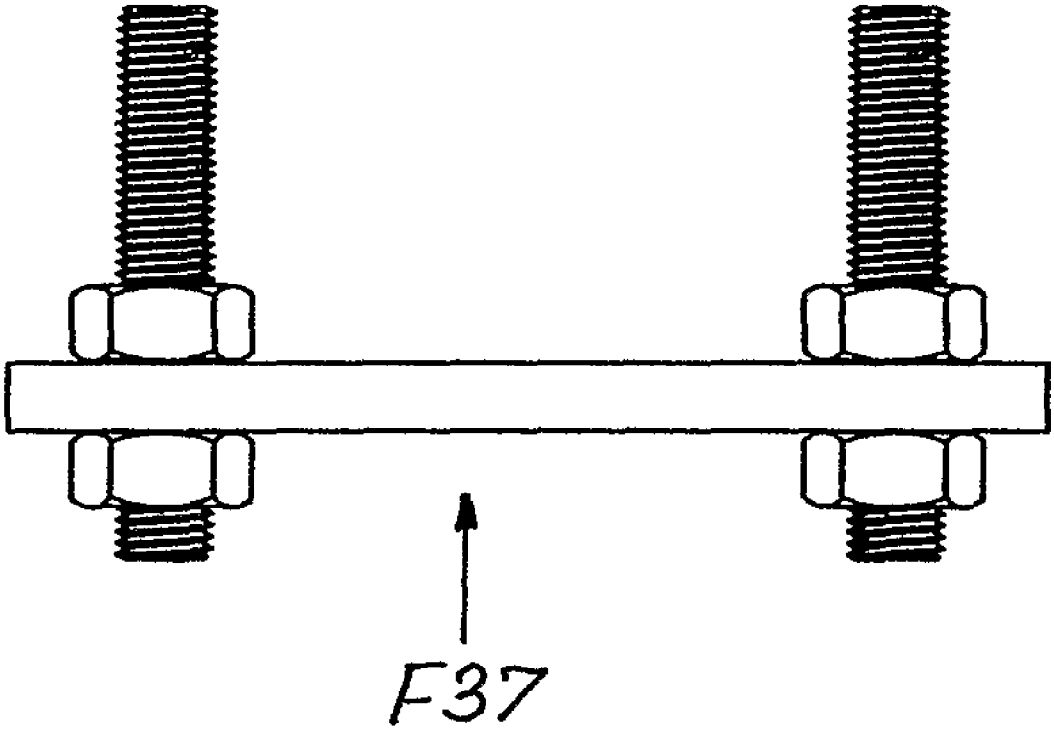
FIGS. 36 and 37 show a variant of the mounting plate 6 of FIG. 1.
Figure 37:
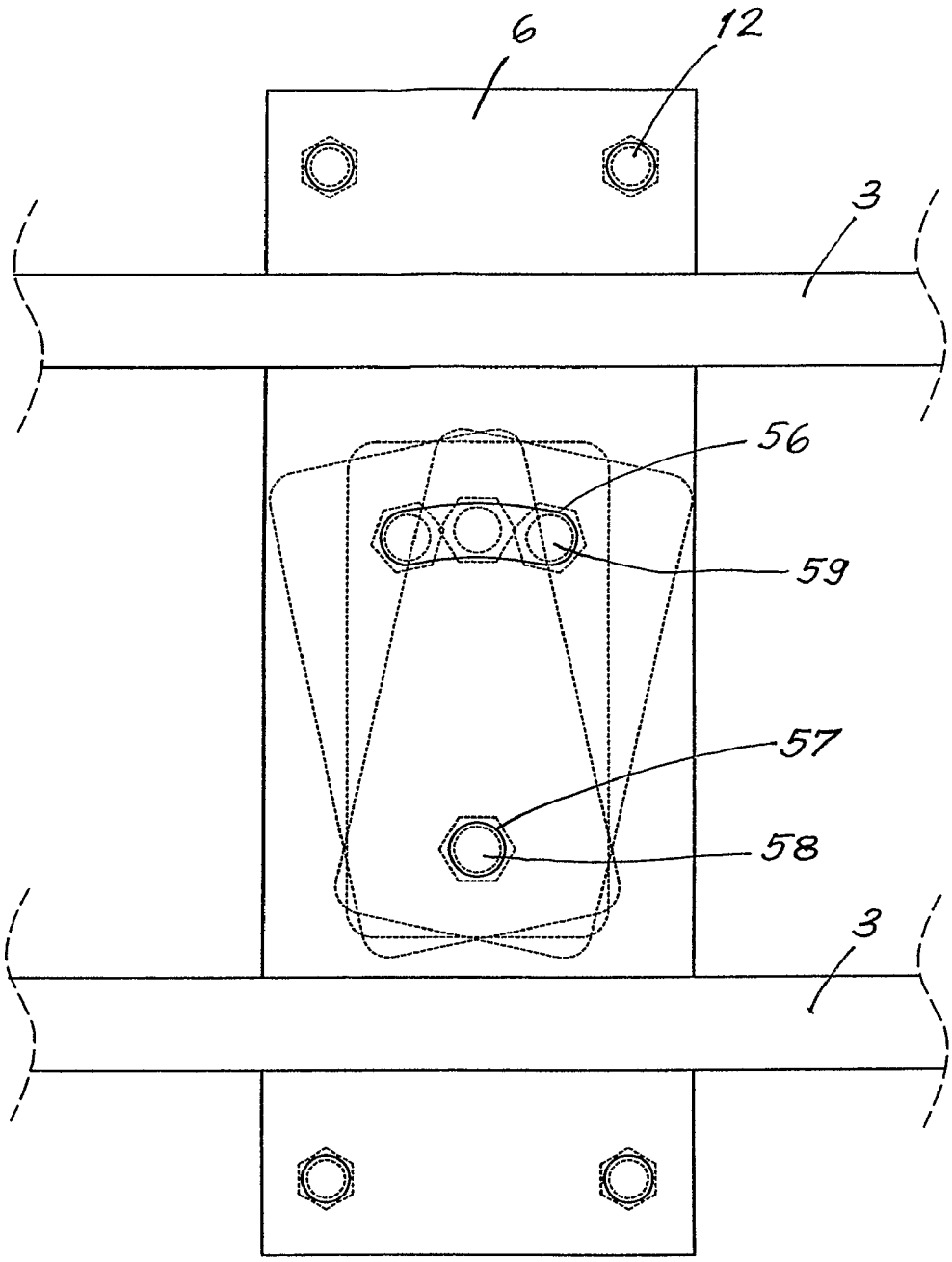

FIG. 36 shows a variant of the mounting plate 6 wherein a groove 56, a slot 57 and extra screws 58 and 59 are provided in order to attach the support extension 8 to the mounting plate 6. The groove 57 is in the form of a partial arch. Screws 58 are used to attach a lower part of the support extension 8 to the mounting plate 6. The slot 57 can then act as a hinge point to allow for vertical adjustment of the position of the top part of the support extension 8 in relation to the mounting plate 6 by means of the groove 56. The screws 59 can then be screwed to fit the support extension 8 into the desired position.

The present invention is in no way limited to the form of embodiment described by way of an example and represented in the figures, however, a fall arrest assembly 1 according to the invention, can be realized in various forms without leaving the scope of the invention.

The invention claimed is:

1. A fall arrest assembly comprising anchor stations mounted to support structures, belay lines supported by the anchor stations for slidably receiving a shuttle mounted to a person traversing the belay lines, a mounting plate having a plurality of openings therethrough, a supporting extension fixed rigidly to the mounting plate, the support extension carrying a shuttle guide, the shuttle guide configured for slidable passage of a shuttle thereover and coupled to the belay lines, a plurality of anchor elements each having a section configured to extend through the plurality of openings in the mounting plate, means for securing the anchor elements to a support structure; and arrest means in a form of a body fixed to at least one of the belay lines by bolts and provided with clips which are spring-biased away from the at least one belay line.

2. A fall arrest assembly according to claim 1, wherein the anchor elements include a threaded rod sized to extend through an opening in the mounting plate and the means for securing the anchor elements are threaded nuts for threadably engaging the threaded rod.

3. A fall arrest assembly according to claim 1 wherein the plurality of openings includes at least four openings and the plurality of anchor elements includes two rods for extending through any two of the openings.

4. A fall arrest assembly according to claim 1 wherein each of the anchor elements includes a strap or band configured to encircle one of the support structures and the mounting plate an arrangement of slots configured to receive the anchor elements therethrough to mount the mounting plate to the support structure.

5. A fall arrest assembly according to claim 1 wherein the assembly further includes a plurality of adjustable spacers supported by the mounting plate and arranged to make contact with an adjacent support structure when the mounting plate is mounted thereto.

6. A fall arrest assembly according to claim 5, wherein the mounting plate is generally rectangular in configuration and the plurality of spacers includes a spacer adjacent each corner of the mounting plate.

7. A fall arrest assembly according to claim 1 wherein the shuttle guide includes:

a tubular body having opposite ends defining internal threads;

a pair of hollow profile tips each having a tapered surface over which a shuttle can slide and a threaded stem for engagement with the internal threads.

8. A fall arrest assembly according to claim 7, wherein each profile tip is tapered on an inside thereof so that one of the belay lines can enter the profile tip under a slight angle but is guided longitudinally by the tapering to be in a centered position within the tubular body.

9. A fall arrest assembly according to claim 7, wherein the assembly further includes a belay line segment forming part of the belay line that extends through one of the pair of hollow profile tips with an end thereof disposed within the tubular body of the shuttle guide.

10. A fall arrest assembly according to claim 1 wherein the shuttle is composed of a generally C-shaped metal body that defines a cable channel through which one of the belay extends when the shuttle is slidably mounted thereon, whereby an entry slot communicates with the channel and provides a means for placing the shuttle onto the one belay line and wherein rollers are mounted within the cable channel.

11. A fall arrest assembly according to claim 1 wherein the support extension includes a support box mounted perpendicularly on the mounting plate and having sides which are rectangular in shape and welded to the mounting plate and a front of which is a support lid fixed to the support box by screws.

12. A fall arrest assembly according to claim 11, wherein the support box of the support extension is connected to the shuttle guide by means of a support profile which is welded with a lower part to an underside of the box.

13. A fall arrest assembly according to claim 12, wherein the support profile is a moat-shaped profile welded by the lower part to the support box.

14. A fall arrest assembly according to claim 1 wherein the assembly further includes a transfer station which includes:

a second mounting plate with second openings through which second anchor elements mount the second mounting plate (33) another support structure;

a transfer shuttle guide configured to slidably receive a shuttle thereon, the transfer shuttle guide being rotatable into alignment with a plurality of second shuttle guides for passage of a shuttle therebetween;

the second shuttle guides being pointed perpendicular to transfer shuttle guide and the another support structure and being configured to slidably receive a shuttle thereon, and one end of each of the second shuttle guides being connected to a different belay line terminating at the transfer station.

15. A fall arrest assembly according to claim 14, wherein the transfer station further includes a rotating barrel which includes segments that define a pass-through slot which permits the passage of a shuttle through the barrel, whereby the barrel is provided with a flange which supports the transfer shuttle guide on an inside of the barrel.

16. A fall arrest assembly according to claim 15, wherein the transfer station further includes at least one of the following:

locking means in a form of a spring mechanism to prevent the shuttle from leaving the transfer shuttle guide once it has passed the pass-through slot and un-locking means to unlock the transfer shuttle guide when a next pass-through slot is aligned with a next shuttle guide;

a pair of handles at a lower end of the barrel that may be grasped to rotate the barrel;

a computer chip or other sensor to measure time of passage or count a number of shuttle passages;

spacers to provide better mounting of the another mounting plate to the another support structure.

17. A fall arrest assembly according to claim 1 wherein the assembly further includes a descent station which includes:

an additional mounting plate with additional openings through which additional anchor elements mount the additional mounting plate to an additional support structure;

at least one additional shuttle guide which is pointed substantially perpendicular to the additional mounting plate and the additional support structure and which is configured to slidably receive a shuttle thereon, one end of the at least one additional shuttle guide being connected to a belay line terminating at the descend station; and a descend shuttle guide configured to slidably receive a shuttle thereon, the descend shuttle guide allowing a vertical transfer of a shuttle.

18. A fall arrest assembly according to claim 17, wherein the descend station further includes at least one of the following:

locking means in a form of a spring mechanism to prevent the shuttle from leaving the descend shuttle guide once it has passed a pass-through slot thereof and un-locking means to unlock the transfer shuttle guide when the pass-through slot is aligned with a next shuttle guide or when a user of the fall arrest assembly has reached the ground;

a computer chip or other sensor to measure time of passage or count a number of shuttle passages; and spacers to provide better mounting of the additional mounting plate to the additional support structure.

19. A fall arrest assembly comprising anchor stations mounted to support structures, belay lines supported by the anchor stations for slidably receiving a shuttle mounted to a person traversing the belay lines, a mounting plate having a plurality of openings therethrough, a supporting extension fixed rigidly to the mounting plate;

the support extension carrying a shuttle guide;

the shuttle guide configured for slidable passage of a shuttle thereover and coupled to the belay lines;

a plurality of anchor elements each having a section configured to extend through the plurality of openings in the mounting plate;

means for securing the anchor elements to a support structure; and a descent station which includes:

an additional mounting plate with additional openings through which additional anchor elements mount the additional mounting plate to an additional support structure;

at least one additional shuttle guide which is pointed substantially perpendicular to the additional mounting plate and the additional support structure and which is configured to slidably receive a shuttle thereon, one end of the at least one additional shuttle guide being connected to a belay line terminating at the descend station; and a descend shuttle guide configured to slidably receive a shuttle thereon, the descend shuttle guide allowing a vertical transfer of a shuttle.

20. A fall arrest assembly comprising anchor stations mounted to support structures, belay lines supported by the anchor stations for slidably receiving a shuttle mounted to a person traversing the belay lines, a mounting plate having a plurality of openings therethrough, a supporting extension fixed rigidly to the mounting plate;

the support extension carrying a shuttle guide;

the shuttle guide configured for slidable passage of a shuttle thereover and coupled to the belay lines;

a plurality of anchor elements each having a section configured to extend through the plurality of openings in the mounting plate;

means for securing the anchor elements to a support structure;

a transfer station which includes:

a second mounting plate with second openings through which second anchor elements mounted to the second mounting plate another support structure;

a transfer shuttle guide configured to slidably receive a shuttle thereon, the transfer shuttle guide being rotatable into alignment with a plurality of second shuttle guides for passage of a shuttle therebetween;

the second shuttle guides being pointed perpendicular to transfer shuttle guide and the another support structure and being configured to slidably receive a shuttle thereon, and one end of each of the second shuttle guides being connected to a different belay line terminating at the transfer station;

a rotating barrel which includes segments that define a pass-through slot which permits the passage of a shuttle through the barrel, whereby the barrel is provided with a flange which supports the transfer shuttle guide on an inside of the barrel; and the fall arrest assembly further including at least one of the following:

locking means in a form of a spring mechanism to prevent the shuttle from leaving the transfer shuttle guide once it has passed the pass-through slot and un-locking means to unlock the transfer shuttle guide when a next pass-through slot is aligned with a next shuttle guide;

a pair of handles at a lower end of the barrel that may be grasped to rotate the barrel;

a sensor to measure time or a number of shuttle passages; and spacers to provide better mounting of the another mounting plate to the another support structure.

* * * * *